US012302966B2

(12) United States Patent
Tryner et al.

(10) Patent No.: US 12,302,966 B2
(45) Date of Patent: May 20, 2025

(54) SPORTS GLOVE

(71) Applicant: Wilson Sporting Goods Co., Chicago, IL (US)

(72) Inventors: Andrew K. Tryner, Chicago, IL (US); Daniel W. Kolcun, Bayonne, NJ (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 18/368,913

(22) Filed: Sep. 15, 2023

(65) Prior Publication Data

US 2024/0130452 A1 Apr. 25, 2024
US 2024/0225151 A9 Jul. 11, 2024

Related U.S. Application Data

(63) Continuation of application No. 16/946,065, filed on Jun. 4, 2020, now Pat. No. 11,793,254.

(51) Int. Cl.
*A41D 19/015* (2006.01)
*A41D 19/00* (2006.01)

(52) U.S. Cl.
CPC ..... *A41D 19/0048* (2013.01); *A41D 19/015* (2013.01)

(58) Field of Classification Search
CPC ..... A41D 19/0048; A41D 19/015
See application file for complete search history.

(56) References Cited

U.S. PATENT DOCUMENTS 2,309,476 A 1/1943 Patterson, Jr.
3,025,526 A * 3/1962 Ramon ..... A41D 13/065 2/24
3,084,458 A * 4/1963 Ramon ..... E04F 21/20 2/24
3,112,812 A * 12/1963 Ramon ..... A41D 13/065 2/24
3,557,156 A 1/1971 Enneper et al.
3,890,649 A 6/1975 Diggins
3,900,024 A 8/1975 Lauber et al.
3,923,049 A 12/1975 Lauber
4,051,553 A 10/1977 Howard
4,235,228 A 11/1980 Gaylord et al.
(Continued)

FOREIGN PATENT DOCUMENTS

GB 205582 3/1981
GB 2200286 8/1988
WO WO 2019148077 8/2019

*Primary Examiner* — Richale L Quinn
(74) *Attorney, Agent, or Firm* — Terence P. O'Brien; Todd A. Rathe

(57) ABSTRACT

A sports glove for being worn by a hand may include a backhand panel and a palm panel joined to the backhand panel to form a palm cavity therebetween. The palm cavity extends from a base portion to a knuckle portion. The sports glove may further include finger stalls extending from the palm cavity, the finger stalls comprising an index finger stall and a thumb stall extending from the palm cavity. The sports glove may further include a slit within the backhand panel. The slit may extend along an axis that crosses the base portion and that intersects the index finger stall, or that extends between the index finger stall and the thumb stall. A securement panel may extend across the slit distal and non-overlapping with respect to a wrist sleeve and a wrist strap.

21 Claims, 12 Drawing Sheets

(56) References Cited

U.S. PATENT DOCUMENTS 4,279,344 A 7/1981 Holloway, Jr.
4,295,229 A 10/1981 Clark et al.
4,301,564 A 11/1981 Dalebout
4,400,829 A 8/1983 Willis
4,411,262 A 10/1983 von Bonin et al.
4,427,002 A 1/1984 Baron et al.
4,428,089 A 1/1984 Dawber et al.
4,433,494 A 2/1984 Courvoisier et al.
4,433,680 A 2/1984 Yoon
4,442,833 A 4/1984 Dahlen et al.
4,484,360 A 11/1984 Leighton et al.
4,502,479 A 3/1985 Garwood et al.
4,559,646 A 12/1985 Ertl
4,570,622 A 2/1986 von Bonin et al.
4,572,171 A 2/1986 Wgner et al.
4,598,429 A 7/1986 Mulvaney
4,676,861 A 6/1987 Bishop
4,690,932 A 9/1987 Mulvaney
4,701,963 A * 10/1987 Overton ..... A41F 1/06 2/167
4,770,299 A 9/1988 Parker
4,832,010 A 5/1989 Lerman
4,837,884 A 6/1989 Hilgrath
4,843,651 A 7/1989 Gramza et al.
4,864,660 A 9/1989 Sawyer
4,869,046 A 9/1989 Parker
4,964,229 A 10/1990 Laberge
4,966,134 A 10/1990 Brewer
5,003,970 A 4/1991 Parker et al.
5,027,803 A 7/1991 Scholz et al.
5,117,509 A 6/1992 Bowers
D327,754 S 7/1992 Hochgesang et al.
5,183,263 A 2/1993 Kuebler
5,295,269 A * 3/1994 Ballard ..... A41D 19/01523 2/161.1
5,316,294 A 5/1994 Turangan
5,335,916 A 8/1994 Nee
5,364,580 A 11/1994 Prent
5,425,701 A 6/1995 Oster et al.
5,511,248 A 4/1996 Widdemer
5,517,694 A * 5/1996 Fabry ..... A41D 19/01582 2/161.4
5,537,692 A * 7/1996 Dorr ..... A41D 19/01588 2/161.1
5,480,376 A 8/1996 Oster et al.
5,544,663 A 8/1996 Duback
5,598,582 A 2/1997 Andrews et al.
5,608,912 A 3/1997 Cumberland
5,636,381 A 6/1997 Brogden
5,637,077 A 6/1997 Parker
5,665,056 A 9/1997 Nakasugi et al.
5,692,242 A 12/1997 Tekerman et al.
5,708,979 A 1/1998 Redwood et al.
5,727,257 A 3/1998 Chen
5,732,713 A 3/1998 Duback et al.
5,745,919 A 5/1998 Kraatz
5,755,678 A 5/1998 Parker et al.
5,802,614 A 9/1998 Melone, Jr.
5,806,091 A 9/1998 McHugh
5,833,637 A 11/1998 Pong
5,867,830 A 2/1999 Chen
5,957,871 A 9/1999 Darcey
5,980,474 A 11/1999 Darcey
6,006,358 A 12/1999 Keating
6,022,331 A 2/2000 Darcey
6,044,494 A 4/2000 Kang
6,049,910 A 4/2000 McCarter
6,052,827 A 4/2000 Widdemer
6,065,155 A 5/2000 Sandusky
6,105,162 A * 8/2000 Douglas ..... A41D 13/0562 2/161.1
6,128,777 A 10/2000 Foreman
6,182,293 B1 2/2001 Mustin
6,185,747 B1 2/2001 Hughes
6,223,353 B1 5/2001 Lardieri, Jr.
6,253,382 B1 * 7/2001 Kleinert ..... A63B 71/143 2/163
6,408,442 B1 6/2002 Kang
6,457,181 B1 10/2002 Grundy
6,526,593 B2 3/2003 Sajovic
6,539,550 B1 4/2003 Flores
6,745,402 B2 6/2004 Caswell
6,745,403 B2 6/2004 Sajovic
6,912,731 B2 7/2005 Cass
6,964,063 B2 11/2005 Bamber
7,210,172 B2 5/2007 Adams, Jr.
7,293,296 B1 11/2007 Beraznik et al.
7,487,553 B2 2/2009 Price
7,669,251 B2 3/2010 Hammons et al.
7,930,768 B1 * 4/2011 Tyler ..... A42B 1/041 2/205
7,966,670 B2 6/2011 Wilbert et al.
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 * 9/2012 Ibon ..... A63B 71/143 2/161.1
8,266,719 B2 9/2012 Duby
8,839,462 B2 9/2014 Webster
9,198,474 B1 12/2015 Hacobian
10,004,975 B2 * 6/2018 Clement ..... A63B 71/145
11,000,085 B2 5/2021 Rodriguez
11,058,940 B2 7/2021 Gilday et al.
11,930,869 B2 * 3/2024 Leone ..... A41D 19/001
12,063,995 B2 * 8/2024 Takahashi ..... A41D 19/0048
2003/0037364 A1 2/2003 Alber
2004/0018899 A1 * 1/2004 Thiruppathi ..... A63B 71/148 473/518
2004/0025226 A1 2/2004 Jaeger
2004/0045074 A1 3/2004 Tremblay
2004/0060097 A1 4/2004 Bamber
2004/0068777 A1 4/2004 Wheelington, II
2004/0107476 A1 6/2004 Goldwitz
2005/0034213 A1 2/2005 Bamber
2007/0174948 A1 * 8/2007 Robba ..... A63B 71/146 2/161.1
2007/0209097 A1 9/2007 Iacullo
2007/0226873 A1 * 10/2007 Mattesky ..... A41D 19/0058 2/159
2008/0010719 A1 * 1/2008 Hoelscher ..... A41D 19/01588 2/161.1
2008/0229477 A1 9/2008 McGrough
2008/0271224 A1 11/2008 Wilbert et al.
2009/0077706 A1 3/2009 Prather
2009/0139007 A1 6/2009 Bevier
2009/0139010 A1 6/2009 Bevier
2010/0024095 A1 2/2010 Gellis
2010/0077526 A1 4/2010 Smeltzer
2010/0077532 A1 4/2010 Kettani
2010/0077533 A1 4/2010 Munda
2010/0095428 A1 4/2010 Fisher
2010/0186140 A1 7/2010 Ramirez
2010/0325777 A1 12/2010 Radakrishnan et al.
2011/0041235 A1 2/2011 Harris
2011/0113521 A1 5/2011 Bradford
2011/0214220 A1 9/2011 Parker
2011/0214221 A1 9/2011 Munda
2011/0258754 A1 10/2011 DuPont
2011/0296582 A1 12/2011 Bevier et al.
2012/0005580 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0159681 A1 6/2012 Gibby
2012/0227158 A1 6/2012 Ashworth et al.
2012/0204319 A1 8/2012 Gambordella
2012/0227155 A1 9/2012 Brown

(56) References Cited

U.S. PATENT DOCUMENTS

2012/0245503 A1* 9/2012 DeVries ..... A41D 19/015 602/21
2012/0324623 A1 12/2012 Cabauy et al.
2013/0000006 A1* 1/2013 Norton ..... A41F 1/06 2/16
2013/0014306 A1 1/2013 Berry
2013/0036523 A1* 2/2013 Webster ..... A41D 19/01523 2/19
2013/0061369 A1 3/2013 Lim
2013/0167281 A1* 7/2013 Jennings ..... B29C 35/002 156/196
2013/0198920 A1* 8/2013 Wittman ..... A41D 13/081 2/16
2013/0227755 A1* 9/2013 Bisaillon ..... A63B 71/141 2/161.1
2013/0239291 A1 9/2013 Harris
2013/0283498 A1* 10/2013 Hewitt ..... A41D 19/0048 2/163
2015/0165302 A1 6/2015 Jaramillo et al.
2015/0314189 A1* 11/2015 Le ..... A63B 71/143 2/16
2016/0051883 A1 2/2016 Clement
2016/0128402 A1 5/2016 Hewitt
2016/0255892 A1 9/2016 Berry
2016/0367881 A1* 12/2016 Le ..... A41F 1/06
2017/0282048 A1* 10/2017 Wittman ..... A63B 71/145
2018/0193718 A1* 7/2018 Gilday ..... A41D 19/01564
2018/0255849 A1* 9/2018 Paquette ..... A63B 71/143
2019/0082759 A1* 3/2019 Berry ..... A41F 1/06
2019/0231003 A1* 8/2019 Morris ..... A41D 13/065
2020/0405320 A1* 12/2020 Kawamoto ..... A61B 17/1325
2021/0007873 A1* 1/2021 Frederick ..... A63B 71/141
2021/0052968 A1* 2/2021 Ciaglia ..... A63B 71/141
2021/0378332 A1* 12/2021 Tryner ..... A41D 19/015
2022/0088464 A1* 3/2022 Kawiya ..... A41D 19/01547
2022/0212087 A1* 7/2022 Kucharsky ..... A41D 13/0156

* cited by examiner

SPORTS GLOVE

CROSS-REFERENCE TO RELATED PATENT APPLICATIONS

The present application is a continuation patent application claiming priority under 35 USC § 120 from co-pending U.S. patent application Ser. No. 16/946,065 filed on Jun. 4, 2020 by Tryner et al. and entitled SPORTS GLOVE, the full disclosure of which is hereby incorporated by reference.

BACKGROUND

Gloves are often employed in sports to protect a participant's hands and to enhance performance.

Figure 1:
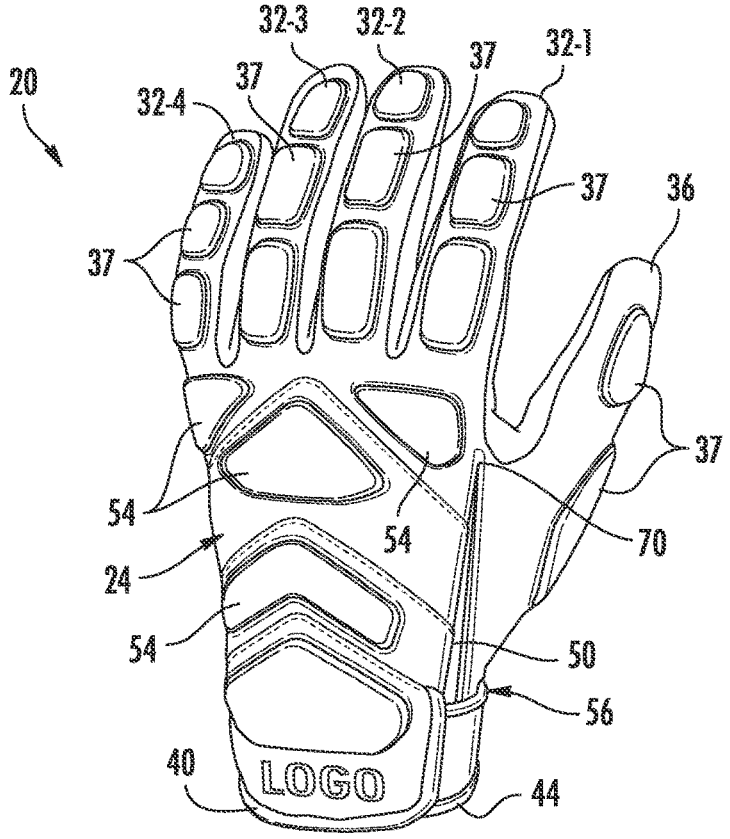
FIG. 1 is a perspective view of a rear of an example sports glove.

Throughout the drawings, identical reference numbers designate similar, but not necessarily identical, elements. The Figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION OF EXAMPLES

Disclosed are various examples of sports gloves that may accommodate a wider array of hand sizes and/or protective inserts that may provide enhanced protection for a person's hands, wrists and/or forearms. The example sports gloves may accommodate a wider array of hand sizes by including a slit or gap within the backhand panel of the glove, wherein the slit distally extends from a base portion of the hand receiving cavity of the glove, a palm cavity, to a terminus or endpoint that is located at an index metacarpal, or between an index metacarpal and a thumb metacarpal, of the hand received within the glove. The slit facilitates expansion of those backhand portions of the glove to facilitate easier insertion of the hand into the glove.

The slit may also facilitate the additional inclusion of a protective insert adjacent to a base of the thumb, such as a protective insert that wraps around or about the base or metacarpal of the thumb. In some implementations, the protective insert may comprise a compressible, yet bendable pad that is retained in an arcuate shape by the glove. In another implementation, the protective insert may comprise a moldable and hardenable panel such as a panel including gel to shell technology, commercially available from EVOSHIELD®. For example some implementations, the moldable and hardenable panel may be inserted between the base of the thumb and the interior surface of the glove as a glove is being worn, wherein the panel is shaped or molded about base of the thumb and subsequent hardens while the glove is being worn to a shape that form fits to the hand of the person wearing the glove.

In some implementations, to provide additional stability and support for the thumb and to better secure the protective insert (when provided), the example sport glove may include a securement panel. The securement panel may be anchored on one side of the slit and may be releasably connectable to the other side of the slit, bridging the slit and limiting expansion of the slit once a glove is worn. For purposes of this disclosure, the term "releasably" or "removably" with respect to an attachment or coupling of two structures means that the two structures may be repeatedly connected and disconnected to and from one another without material damage to either of the two structures or their functioning. In some implementations, the securement panel may be anchored at two spaced locations on different sides of the base of the thumb, wherein portions of the securement panel are detached from the remainder the glove between the space locations, free-floating, to provide enhanced mobility of the thumb such as when a grip is being closed.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The example sports gloves may provide enhanced protection for person's hand, wrist and forearm by including a wrist strap that supports a protective insert that extends in an arc so as to wrap about the ulna bone or ulna side of a person's wrist and/or forearm. In various sports, the ulna side of a person's wrist and/or forearm may be particularly susceptible to contact and injury. For example, when a baseball or softball player is in a batting stance, the ulna side of the player's forearm and wrist often face an oncoming pitch. When an American football lineman is blocking an opposing defensive player, the ulna side of the player's forearms and wrists often face the defensive player. By supporting a protective insert across and about the ulna side of the wrist and forearm, the example sports gloves better protect this vulnerable portion of the player's anatomy.

Disclosed is an example sports glove for being worn by a hand. The example sports glove may include a backhand panel and a palm panel joined to the backhand panel to form a palm cavity therebetween. The palm cavity extends from a base portion to a knuckle portion. The sports glove may further include finger stalls extending from the palm cavity, the finger stalls comprising an index finger stall and a thumb stall extending from the palm cavity. The sports glove may further include a slit within the backhand panel, the slit distally extending from the base portion to a terminus between an index metacarpal and a thumb metacarpal of the hand received within the glove. The sports glove may further or alternatively include a wrist strap containing a protective insert that extends in an arc about an ulna side of a forearm.

Disclosed is an example sports glove for being worn by a hand. The sports glove may comprise a backhand panel and a palm panel joined to the backhand panel to form a palm cavity therebetween. The palm cavity extends from a base portion to a knuckle portion. The sports glove may further include finger stalls extending from the palm cavity, the finger stalls comprising an index finger stall and a thumb stall extending from the palm cavity. The sports glove may comprise a wrist sleeve extending from the base portion of the palm cavity and an elastic wrist strap to wrap about the wrist sleeve. The elastic wrist strap comprises a pocket to contain a moldable and hardenable protective insert.

Disclosed is an example sports glove for being worn by a hand. The sports glove may comprise a backhand panel and a palm panel joined to the backhand panel to form a palm cavity therebetween. The palm cavity extends from a base portion to a knuckle portion. The sports glove may further include finger stalls extending from the palm cavity, the finger stalls comprising an index finger stall and a thumb stall extending from the palm cavity. The sports glove may comprise a wrist sleeve extending from the base portion of the palm cavity and an elastic wrist strap to wrap about the wrist sleeve. The elastic wrist strap may further comprise a pocket to contain a protective insert extending in an arc wrapping about an ulna side of a forearm connected to the hand.

Figure 2:
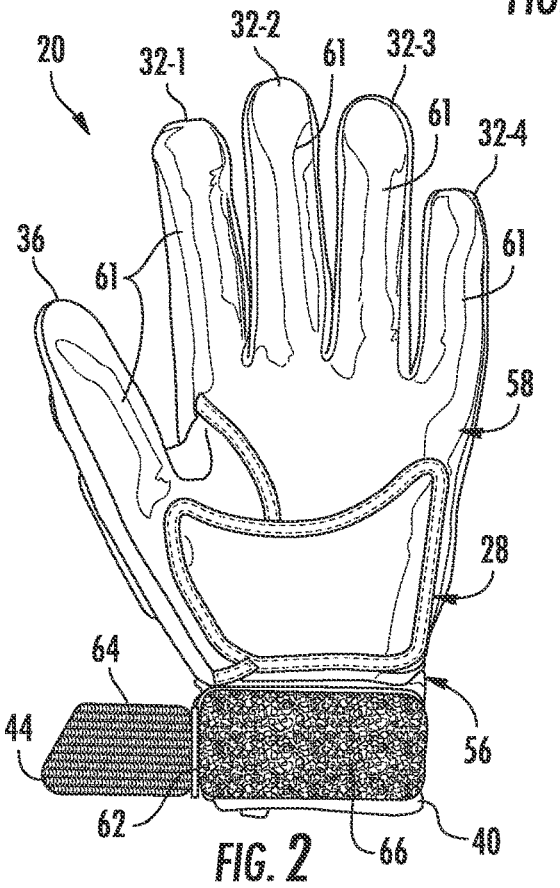
FIG. 2 is a perspective view of a front of the example sports glove of FIG. 1 with a released wrist strap.
Figure 3:
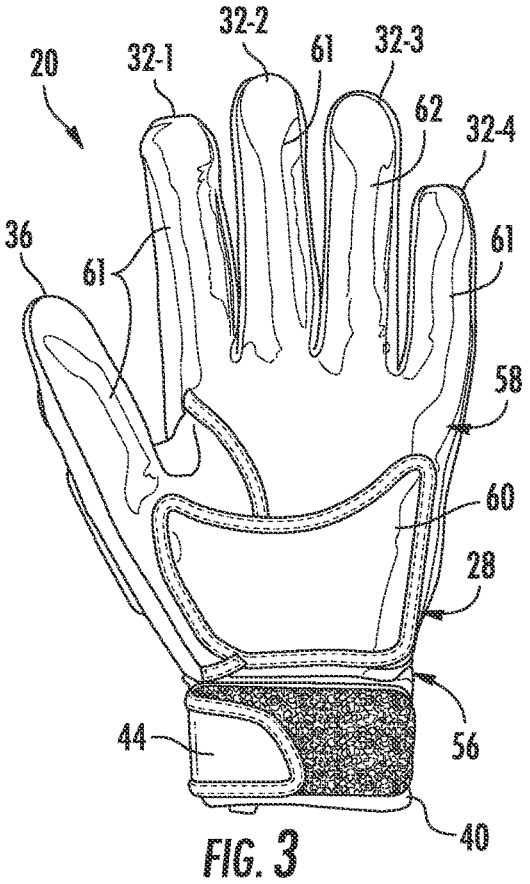
FIG. 3 is a perspective view of the front of the example sports glove of FIG. 2 with the wrist strap being closed.

FIGS. 1-3 illustrate an example sports glove 20 for being worn by a person's hand. Sports glove 20 comprises backhand panel 24 (shown in FIG. 1), palm panel 28 (shown in FIGS. 2 and 3), finger stalls 32-1, 32-2, 32-3 and 32-4 (collectively referred to as finger stalls 32), thumb stall 36, wrist sleeve 40, wrist strap 44 and slit 50. Backhand panel 24 comprises a panel that is to extend along the back of a person's hand, generally from a base of the person's hand proximate the wrist to the joints joining the metacarpals and the proximal phalanges of the person's fingers (the knuckles), when the glove is being worn.

In one implementation, the backhand panel 24 may be formed from a flexible material such as a flexible fabric, leather or synthetic leather. In some implementations, the backhand panel 24 may be formed from multiple smaller panels stitched, welded or otherwise joined to one another. In some implementations, portions of the back panel or an entirety of the back panel may be resiliently stretchable or elastic. In the example illustrated, backhand panel 24 comprises several pads 54 carried within individual pockets or otherwise joined to an exterior of backhand panel 24. In other implementations, such pads 54 may be omitted.

Palm panel 28 comprises a panel or multiple panels of material joined to backhand panel 24 to form a palm cavity therebetween. The palm cavity covers a palm of the hand and extends from a base portion 56 to a knuckle portion 58. In the example illustrated, the external surfaces of palm panel 28 are coated with or support a grip enhancing material 60. For example, in one implementation, palm panel 28 may be formed from a flexible fabric, which may or may not be stretchable, wherein at least one panel of a rubber-like material, such as Lycra®, is bonded or sewn over the flexible fabric. The grip enhancing material 60 provides enhanced grip-ability and performance. In one implementation, gripping material 60 has an outer surface having a coefficient of friction that is greater than the coefficient of friction of underlying base material of palm panel 28 or other portions of the sports glove 20.

In one implementation, gripping material 60 comprises a layer of resilient rubber or a rubber-like polymer, such as silicone. In one implementation, gripping material 60 comprises a layer of suede, leather or other material that is breathable, but which has a greater rigidity, a lesser flexibility or a lower level of elasticity as compared to the underlying portions of panel 28. In one implementation, gripping material 60 is smooth and flat. Because gripping material 60 is smooth or flat, gripping material 60 has an exterior surface that provides a greater surface area for contacting a caught football (or other ball or projectile). In other implementations, gripping material 60 may have a dimpled, serrated or other surface configuration. Gripping material 60 has an outer surface having a coefficient of friction with leather that is greater than the coefficient of friction of the underlying material of panel 28 with leather. In one implementation, gripping material 60 is inelastic. In some implementations, gripping material 60 may be omitted.

Finger stalls 32 comprise tubular structures extending from backhand panel 24 and palm panel 28 (from the formed palm cavity) to receive a person's fingers when glove 20 is fit onto a hand. Finger stall 32-1 comprises an index finger stall located and sized to receive a person's index finger. Finger stall 32-2 comprises a middle finger stall to receive a person's middle finger. Finger stall 32-3 comprises a ring finger stall to receive a person's ring finger. Finger stall 32-4 comprises a pinky stall to receive a person's pinky.

Thumb stall 36 comprise a generally tubular structure extending from backhand panel 24 and palm panel 28 (forming the palm cavity) and is located relative to finger stalls 32 so as to receive a person's thumb when glove 20 is fit onto a hand. Thumb stall 36 is joined to the index finger stall 32-1 by what may be referred to as a snuff box region.

In the example illustrated, each of finger stalls 32 and thumb stall 36 have a back side (shown in FIG. 1 and extending from backhand panel 24) that supports at least one pad 37. The pad may be captured within a fixed pocket or maybe bonded, sewn otherwise secured to the exterior of each of the stalls 32, 36. In some implementations, all or some of the pads 37 may be omitted.

In the example illustrated, each of the finger stalls 32 and thumb stall 36 have a front side (shown in FIGS. 2 and 3 and extending from palm panel 28) further carrying or supporting a gripping material 61, similar to gripping material 60 described above. In the example illustrated, the gripping material 61 may comprise a continuous panel of gripping material or may comprise individual separate panels of gripping material, wherein the multiple gripping panels are separated from one another at the joints of the fingers or thumb.

Wrist sleeve 40 comprises a generally tubular band of material extending from base portion 56 of the palm cavity in a direction away from finger stalls 32. Wrist sleeve 40 generally extends about a person's wrist adjacent to the person's hand. In the example illustrated, wrist sleeve 40 includes a slit 62 extending across wrist sleeve 40 to facilitate increasing of the size of the opening of wrist sleeve 40. In the example illustrated, slit 62 is connected to slit 50.

Wrist strap 44 comprises a strap anchored to wrist sleeve 40 on a side of slit 62 and releasably connectable to wrist sleeve 40 on an opposite side of slit 62. In one implementation, wrist strap 44 is flexible, but inelastic. In another implementation, strap 44 is elastic. Wrist strap 44 extends across slit 62 to close sleeve 40. In the example illustrated, strap 44 has an inner surface that releasably connects to an outer surface of wrist sleeve 40. In one implementation, wrist strap 44 has an inner surface comprising a first portion 64 of a hook and loop fastener arrangement, whereas the external surface of wrist sleeve 40 has a second portion 66 of the hook and loop fastener arrangement (VELCRO®). FIG. 2 illustrates wrist strap 44 disconnected or released, allowing expansion of the opening through wrist sleeve 40. FIG. 3 illustrates wrist strap 44 extending across slit 62 and secured the opposite side of first sleeve 40, securing glove 20 on person's hand. In other implementations, slit 62 may be omitted or may be provided on the ulna side (the pinky side) of wrist sleeve 40. The wrist sleeve 40 and the wrist strap 44 can be formed in different sizes so as to cover a portion of the user's wrist, all of the user's wrist, or all of the user's wrist and a portion of user's forearm.

Slit 50 (shown in FIG. 1) comprises an elongated opening extending through or within backhand panel 24. Slit 50 distally extends from base portion 56 of the palm cavity to a terminus 70 that is located between a portion of finger stall 32-1 and thumb stall 36. In the example illustrated, terminus 70 is located between an index metacarpal (the metacarpal of the index finger received within finger stall 32-1) and a thumb metacarpal (the metacarpal of the thumb received within thumb stall 36) of the hand received within glove 20. In one implementation, slit 50 has a length of at least 1.5 inches extending from base portion 56 to terminus 70. In one implementation, slit 50 has a length of at least 2 inches. In another implementation, the slit 50 has a length of at least 3 inches. In another implementation, the slit has a length of at least 4 inches. In the example illustrated, the end of slit 50 opposite terminus 70 connects to or communicates with the opening of slit 62 to facilitate wider expansion of slit 50. In other implementations, the opening forming slit 50 may be closed, not connected to slit 62.

Slit 50 separates portions of backhand panel 24 from opposite connecting portions of thumb stall 36. Slit 50 allows the spacing between backhand panel 24 and the opposite connecting portions of thumb stall 36 to be adjusted or widened to allow insertion of larger hands into glove 20. This may be especially important for sports participants who have larger hands, such as linemen. The slit 50 is also significantly advantageous in that it allows a user to place the glove or gloves onto his or her hand or hands, and adjust the gloves, quickly and effectively, which can be useful for many sports applications or uses of the sports glove 20. In some implementations, the opposite edges of slit 50 may be spread apart to further facilitate the additional insertion of a protective insert adjacent to a base of the thumb, such as a protective insert that wraps around or about the base or metacarpal of the thumb. In another implementation, the terminus 70 of the slit 50 may be positioned at the metacarpal of the index finger. In another implementation, terminus 70 may be positioned at the thumb stall. In other implementations, the terminus 70 of the slit 50 and the slit can be positioned at other locations about the back panel 24.

In some implementations, the protective insert may comprise a compressible, yet bendable pad that is retained in an arcuate shape by the glove. In another implementation, the protective insert may comprise a moldable and hardenable panel such as a panel including Gel to Shell® technology, commercially available from EVOSHIELD®. For example, in some implementations, the moldable and hardenable panel may be inserted between the base of the thumb and the interior surface of the glove as a glove is being worn, wherein the panel is shaped or molded about base of the thumb and subsequent hardened or cured, while the glove is being worn, to a shape that form fits to the hand of the person wearing the glove. Alternatively, the moldable and hardenable panel can be heated up, then formed about the base of the thumb of the user, retained there, and cured and hardened. The hardened panel can then be worn within glove 20.

Figure 4:
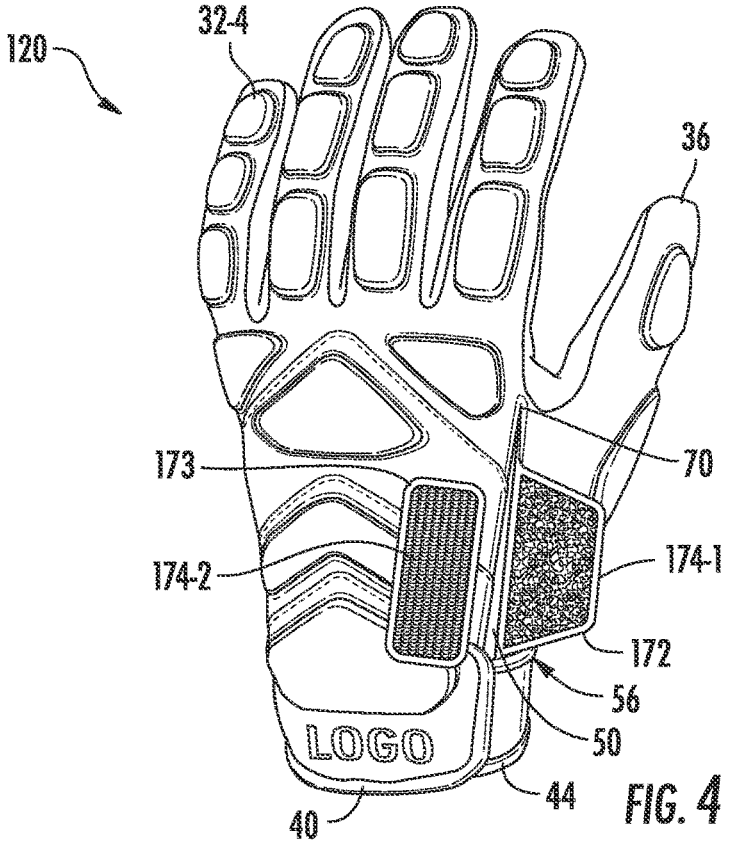
FIG. 4 is a perspective view of a rear of an example sports glove with an undeployed securement panel.
Figure 5:
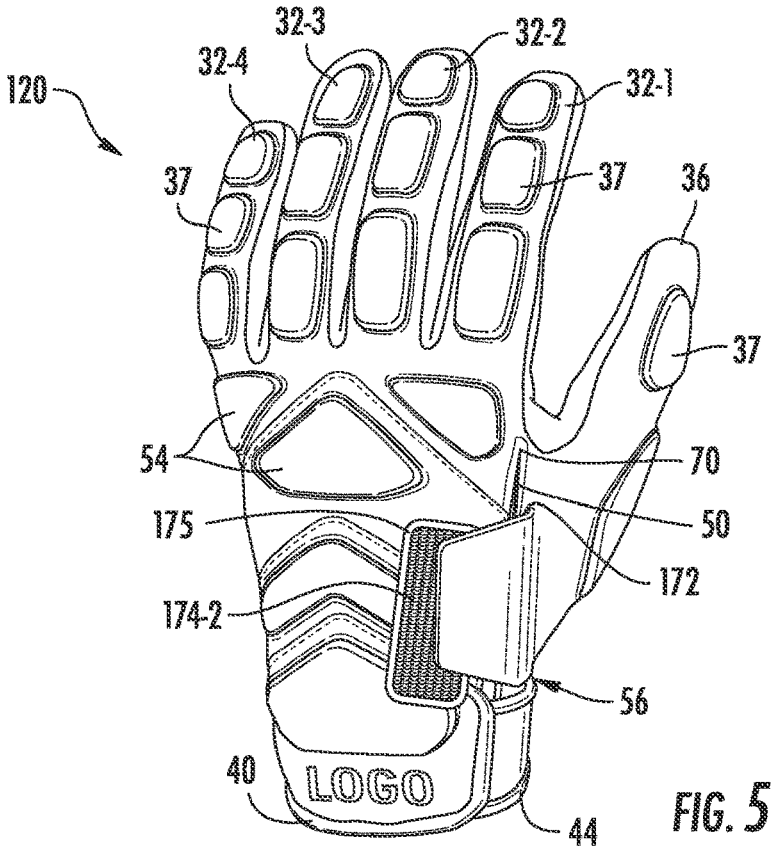
FIG. 5 is a perspective view of a front of the example sports glove of FIG. 4 with the securement panel being deployed.

FIGS. 4 and 5 illustrate example sports glove 120. Sports glove 120 is similar to sports glove 20 described above except that sports glove 120 additionally comprises securement panel 172. The remaining components of sports glove 120, which correspond to components of sports glove 20, are numbered similarly and/or are shown in FIGS. 1-3.

Securement panel 172 comprises a flexible panel anchored to one side of slit 50 between terminus 70 and base 56. As shown by FIGS. 4 and 5, securement panel 172 is bendable or pivotable from a first slit opening position shown in FIG. 4 to a second slit closing position shown in FIG. 5. In the slit opening position, the opposite sides of slit 50 are not directly connected to one another and are not bridged, allowing the outsides of slit 50 to be spread apart to varying extents, as desired, to facilitate easier insertion of a person's hand into glove 120 and/are to facilitate the insertion of a protective insert between glove 120 and the hand inserted into glove 120. Although FIG. 4 illustrates wrist strap 44 in a closed state, it should be appreciated that wrist strap 44 may also be released or disconnected, allowing portions of wrist sleeve 41 on opposite sides of slit 62 (shown in FIG. 2) to be expanded or spread apart, also allowing the outsides of slit 50 to be further spread apart.

In the slit closing position shown in FIG. 5, securement panel 172 extends across slit 50 and is releasably connected to an opposite side of slit 50. In the slit closing position, secure panel 72 bridges slit 50 to restrict or limit extent to which the width of slit 50 may be increased, retaining the sides of slit 50 to a maximum spaced apart distance. As a result, once a person has inserted his or her hand into glove 120 and/or has inserted a protective insert, panel 172 may be releasably secured to the other side of slit 50 to close slit 50 to better retain the person's hand and/or protective insert within glove 120 and to provide more stability to thumb stall 36.

In the example illustrated, securement panel 172 is illustrated as being anchored to glove 120 on a side of slit 50 closest to thumb stall 36, wherein securement panel 172 extends away from thumb stall 36 towards finger stall 32-4 when in the slit closing position. In other implementations, this arrangement may be reversed. In particular, securement panel 172 may alternatively be anchored to backhand panel 24 on the side of slit 50 closest to finger stall 32-4, wherein securement panel 172 bridges or extends across slit 50 and is releasably secured to a side of slit 50 closest to thumb stall 36.

In the example illustrated, securement panel 172 is releasably secured in the slit closing position using a hook and loop fastener arrangement. In the example illustrated, an inner surface of securement panel 172 includes one of a hook and loop 174-1 while the opposite side of slit 50 supports or carries panel or patch 175 having the other of the hook and loop 174-2. This arrangement facilitates the connection of securement panel 172 to a variety of different locations and positions, providing a multitude of different slit spacings or widths to accommodate differently sized hands and/or protective inserts. In other implementations, securement panel 174 may be releasably connected to an opposite side of slit 50 by other fasteners or connection mechanisms. In one implementation, the securement panel and the wrist sleeve can be combined into one securement component or assembly.

Figure 6:
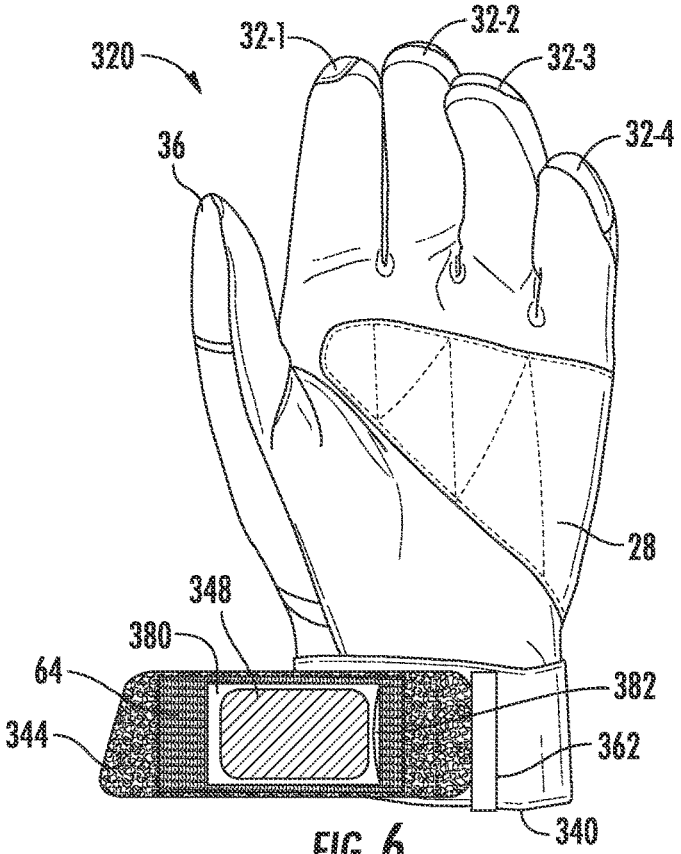
FIG. 6 is a perspective view of a front of an example sports glove with a wrist strap being opened.
Figure 7:
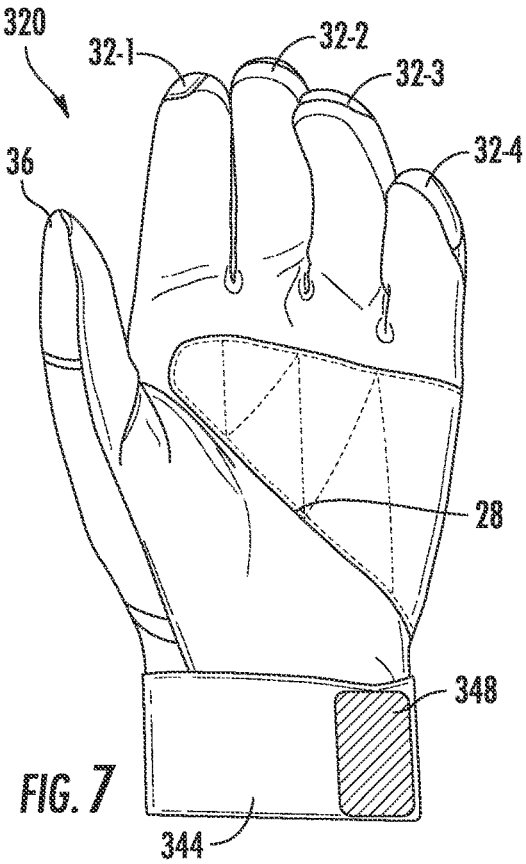
FIG. 7 is a perspective view of the front of the example sports glove of FIG. 6 with the wrist strap being closed.
Figure 8:
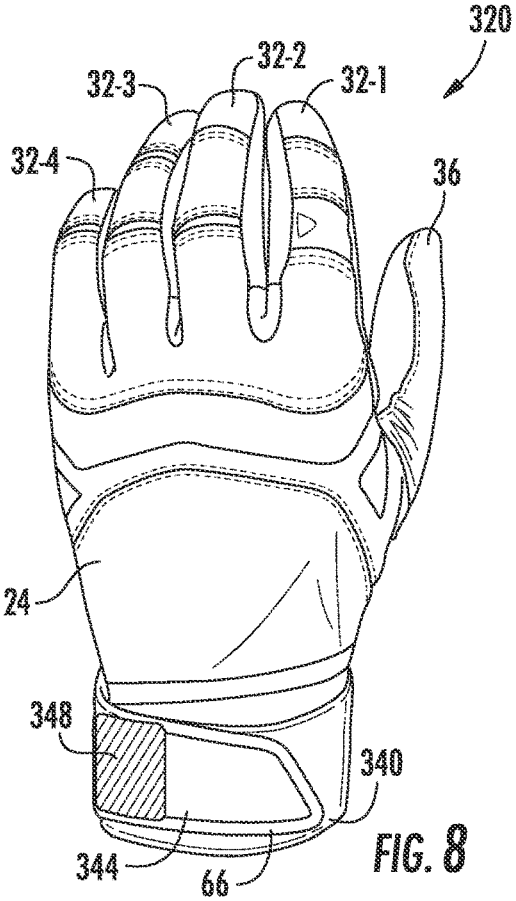
FIG. 8 is a perspective view of a rear of the example sports glove of FIG. 7 with the wrist strap being closed.

FIGS. 6-8 illustrate an example sports glove 320. Sports glove 320 provides enhanced protection for the ulna side (pinky side) of a person's wrist and forearm adjacent to the hand wearing glove 320. Sports glove 320 is similar to sports glove 20 described above except that sports glove 320 omits slit 50, omits pads 37 and 54, and comprises wrist sleeve 340, wrist strap 344 and protective insert 348 in place of wrist sleeve 40 and wrist strap 44. The remaining components of sports glove 320, which correspond to and/or are similar to components of sports glove 20 are numbered similarly.

In the example illustrated, sports glove 320 is adapted for use as a batting glove for use by a baseball or softball player. It should be appreciated that sports glove 320 may be used with other sporting activities or other non-sporting activities as well. Although structurally similar components of sport glove 320 are numbered similarly as compared to their structural component counterparts in glove 20, it should be appreciated that the individual structural components may be formed from slightly different materials having different degrees of durability, flexibility, resiliency and/or gripability to suit the particular sport or activity for which glove 320 is to be used. Such analogous structural components may have different proportions or sizes. In some implementations, glove 320 may additionally include slit 50 as described above. In some implementations, glove 320 may additionally include both slit 50 and securement panel 172 (and the attachment patch 175) as described above.

Wrist sleeve 340 is similar to wrist sleeve 40 described above except that wrist sleeve 340 comprises an elongated slit 362 (shown in FIG. 6). Slit 362 splits wrist sleeve 340 to allow expansion of wrist sleeve 340 to facilitate insertion of a person's hand into the palm cavity and into glove 320. In the example illustrated, slit 362 extends along a front of wrist sleeve 340, adjacent to palm panel 28 and closer to finger stall 32-4 as compared to thumb stall 36. In some implementations, wrist sleeve 340 may omit slit 362.

Wrist strap 344 is similar to wrist strap 44 described above except that wrist strap 344 comprises a protective insert retainer in the form of a pocket 380 that contains protective insert 348. Pocket 380 is located and sized so as to retain protective insert 348 opposite to the ulna side of the wrist and the ulna bone of the forearm when wrist strap 344 is wrapped about the person's wrist, extending from the front of wrist sleeve 340, adjacent to palm panel 28, around the side of the person's hand to the back of wrist sleeve 340, adjacent to backhand panel 24. The pocket 380 and the protective insert 348 are shown in one example size and shape in FIG. 6. In other implementations, the wrist sleeve 344, the protective insert 348 and/or the pocket 380 can be formed in other sizes and other shapes to match a particular players hand and/or wrist size, the desired amount of protection, the particular application the glove, a desired style or other consideration.

In one implementation, pocket 380 extends between a panel having an outer surface supporting one component 64 of a hook and loop fastener arrangement, which releasably connects to the other component 66 of the hook and loop fastener arrangement supported on a back of wrist sleeve 340, adjacent to back hand panel 24. In one implementation, pocket 380 is sealed by stitching, adhesives or the like to permanently retain protective insert 348 within pocket 380. In other implementations, pocket 380 may include an insertion opening 382 through which protective insert 348 may be removably inserted into pocket 380, allowing protective insert 380 to be replaced or removed when glove 320 is to be used without protective insert 348.

In other implementations, wrist strap 344 may include other forms of retainer to secure protective insert 348 in place. For example, in another implementation, wrist strap 344 may include a first portion of a hook and loop arrangement, wherein the protective insert has a surface including a second portion of the hook and loop arrangement, facilitating removable connection and securement of the protective insert 348 to wrist strap 344. In one implementation, the area, length or size of the first portion of hook and loop arrangement on the wrist sleeve 344 may be greater than the area, length or size of the protective insert 348, facilitating the releasable connection and securement of the protective insert 348 to the wrist strap 344 at any one of a variety of different locations to suit the preferences of the person wearing the glove. In addition, the hook and loop arrangement may also be used to allow use of differently sized protective inserts; the size of the protective insert not being limited based upon the size of any pocket.

In one implementation, the opposite side of the protective insert 348 may include a first portion of a hook and loop arrangement, wherein the wrist sleeve 340 includes a second portion of the book and loop arrangement, facilitating releasable connection and securement of the protective insert 348 to wrist sleeve 340. In one implementation, the area or length of the second portion of hook and loop arrangement on the wrist sleeve 340 may be greater than the area are size of the protective insert 348, facilitating the releasable connection and securement of the protective insert 348 to the wrist sleeve 340 at any one of a variety of different locations to suit the preferences of the person wearing the glove.

Protective insert 348 is sized and located such that when it is within pocket 380, protective insert 348 wraps about an extends over the ulna side (pinky side) of the wrist and the ulna bone of the forearm when glove 320 is being worn. As shown by FIGS. 7 and 8, which illustrate the extent and positioning of protective insert 348 when the strap 344 is wrapped around the person's wrist and is secured, protective insert 348 extends in an arc so as to wrap about the ulna bone or ulna side of a person's wrist and/or forearm. As described above, in various sports, the ulna side of a person's wrist and/or forearm may be particularly susceptible to contact and injury. For example, when a baseball or softball player is in a batting stance, the ulna side of the player's forearm and wrist often face an oncoming pitch. When an American football lineman is blocking in opposing defensive player, the ulna side of the players forearm and wrist often face the defensive player. By supporting a protective insert across and about the ulna side of the wrist and forearm, the example sports gloves better protect this vulnerable portion of the player's anatomy.

Figure 9:
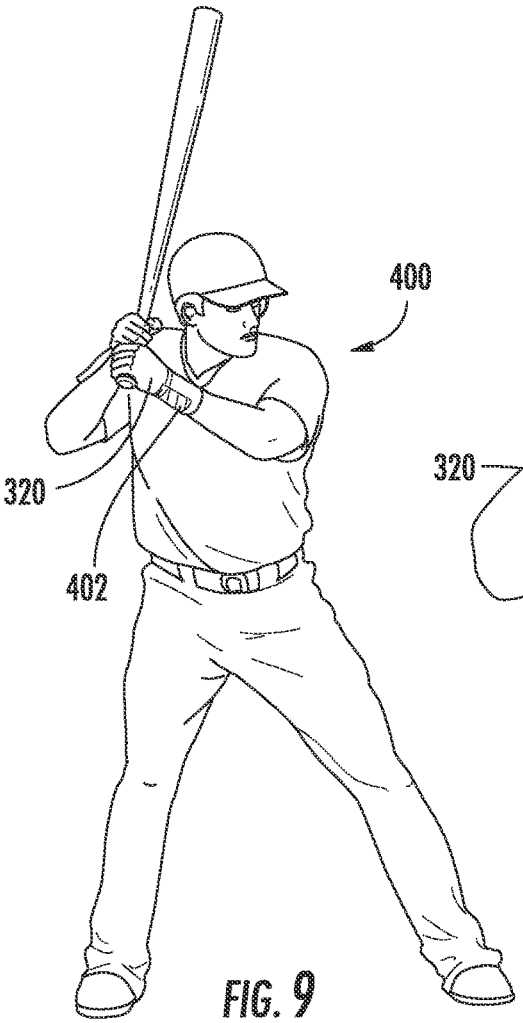
FIG. 9 is a front view of an example batter in a batter's stance.
Figure 10:
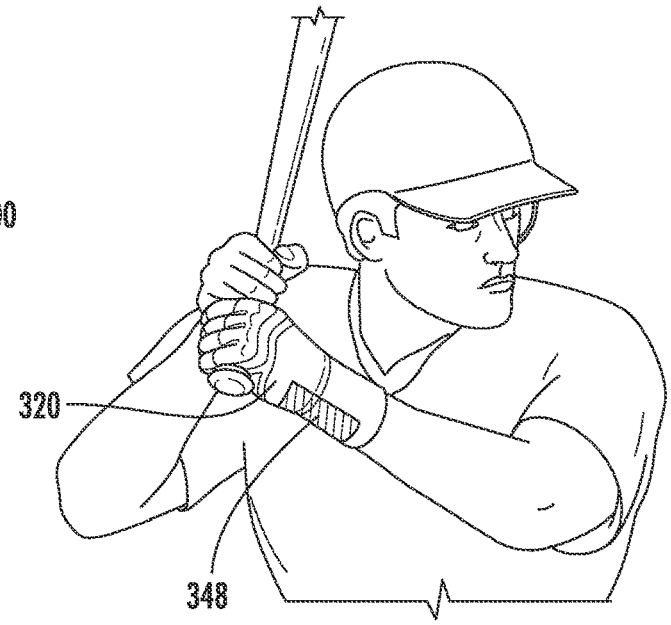
FIG. 10 is an enlarged view of the batter of FIG. 9, illustrating an ulna side of the batter's wrist and forearm being protected by a protective insert carried by an example glove similar to the glove of FIGS. 6-8.

FIG. 9 illustrates an example batter 400 in a batting stance awaiting a pitch. FIG. 10 is an enlarged view of the batter 400 shown in FIG. 9. As shown by such FIGS., in the batting stance, the ulna side 402 of the player's wrist and forearm generally face the strike zone, and can be angled toward the pitcher. During swinging, the ulna side 402 of the player's wrist and forearm may face the pitcher and the oncoming pitched ball. As result, the ulna side 402 is exposed to direct impact from the oncoming pitched ball.

FIG. 10 illustrates the positioning of protective insert 348 by glove 320. Protective insert 348 is retained in an arcuate cross-sectional shape, wrapping about the ulna side of the player's wrist and forearm, protecting the ulna side of the player's wrist and forearm. As noted above, in some implementations, protective insert 348 may comprise a soft compressible pad. In other implementations, protective insert 348 may comprise a molded and cured or hardened panel or shell, such as a shell formed from gel to shell technology.

Figure 11:
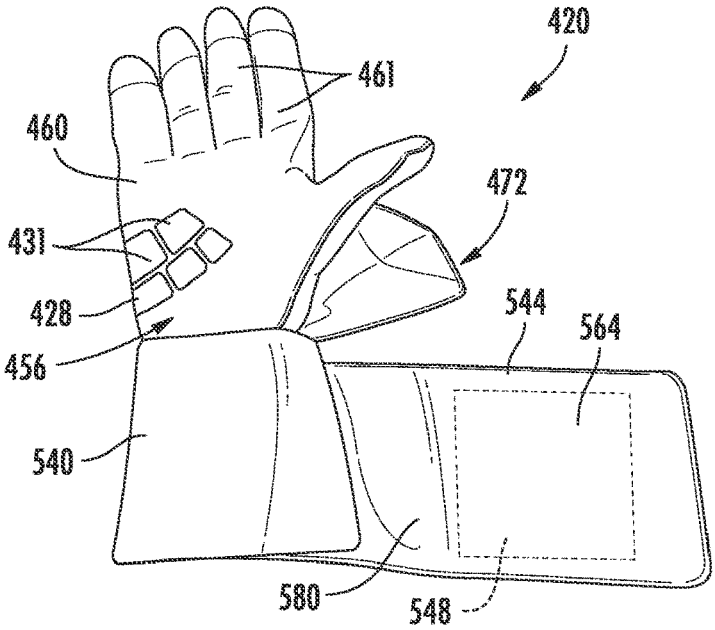
FIG. 11 is a perspective view of a front of an example sports glove with an undeployed securement panel and an unwound or open wrist strap.
Figure 12:
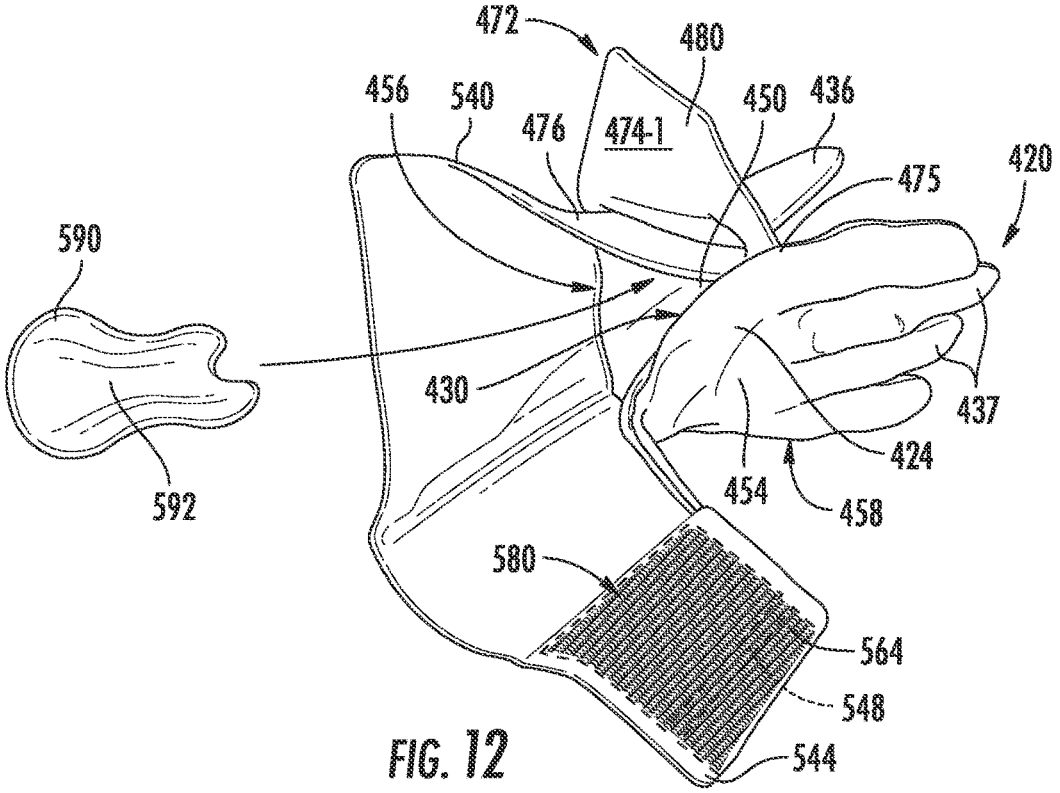
FIG. 12 is a perspective view of a rear of the example sports glove of FIG. 11 with a protective thumb insert shown prior to insertion within the glove.
Figure 13:
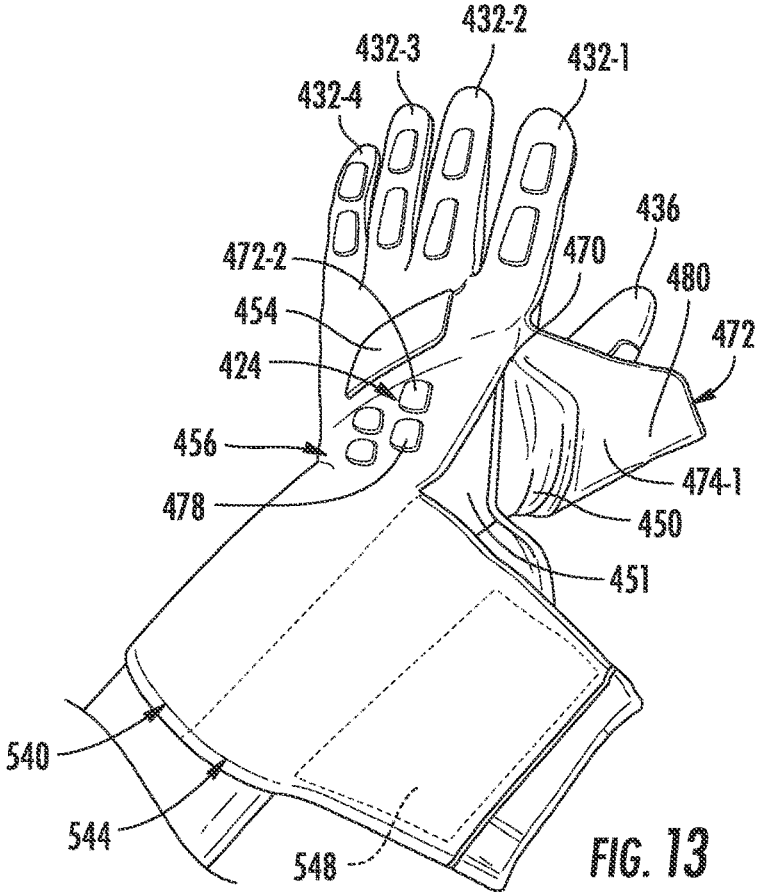
FIG. 13 is another perspective view of the rear of the example sports glove of FIG. 11 being worn while the securement panel is undeployed and the wrist strap is unwound or open.

FIGS. 11-13 illustrate an example sports glove 420. In the example illustrated, sports glove 420 is illustrated as a lineman glove for American-style football. It should be appreciated that structural components and features of sports glove 420 may also be suitable for incorporation into other sports gloves or other non-sports gloves. For example, structural components and features of sports glove 420 may likewise be employed in a batter's glove. Depending on the particular sport or activity in which sports glove 420 is to be employed, the thickness and choice of materials may slightly vary.

Sports glove 420 incorporates features from each of gloves 120 and 320 described above. Sports glove 420 comprises backhand panel 424 (shown in FIG. 12), palm panel 428 (shown in FIG. 11), finger stalls 432-1, 432-2, 432-3 and 432-4 (collectively referred to as finger stalls 432), thumb stall 436, slit 450, securement panel 472, wrist sleeve 540, wrist strap 544 and protective insert 548. Backhand panel 424 comprises a panel that is to extend along the back of a person's hand, generally from a base of the person's hand proximate the wrist and the joints between the metacarpal has in the proximal phalange of the person's fingers (the knuckles), when the glove is being worn.

In one implementation, the backhand panel 424 may be formed from a flexible material such as a flexible fabric, leather or synthetic leather. In some implementations, the backhand panel 424 may be formed from multiple smaller panels stitched, welded or otherwise joined to one another. In some implementations, portions of the back panel or in entirety of the back panel may be resiliently stretchable or elastic. In the example illustrated, backhand panel 424 comprises several elevated pads 454 carried within individual pockets or otherwise joined to an exterior of backhand panel 424. In other implementations, such pads 454 may be omitted.

Palm panel 428 comprises a panel or multiple panels of material joined to backhand panel 424 to form a palm cavity 430 therebetween. The palm cavity 430 extends from a base portion 456 to a knuckle portion 458 and is to receive a person's palm (as shown in FIG. 13). In the example illustrated, the external surfaces of palm panel 428 are coated with or support a grip enhancing material 460. For example, in one implementation, palm panel 428 may be formed from a flexible fabric, which may or may not be stretchable, and at least one panel of a rubber-like material, such as silicone, is bonded or sewn over the flexible fabric. In another implementation, the grip enhancing material 460 can be used to form a portion of, or all of, the palm panel 428. The grip enhancing material 460 provides enhanced grip ability and performance. In one implementation, gripping material 460 has an outer surface having a coefficient of friction with leather that is greater than the coefficient of friction of underlying base material of palm panel 428.

In one implementation, gripping material 460 comprises a layer of resilient rubber or rubber-like polymer, such as silicone. In one implementation, gripping material 460 comprises a layer of suede, leather or other material that is breathable, but which has a greater rigidity, a lesser flexibility or a lower level of elasticity as compared to the underlying portions of panel 428. In one implementation, gripping material 460 is smooth and flat. Because gripping material 460 is smooth or flat, gripping material 460 has an exterior surface that provides a greater surface area for contacting a caught football (or other ball or projectile). In other implementations, gripping material 460 may have a dimpled surface, a serrated surface or other surface configuration. Gripping material 460 has an outer surface having a coefficient of friction with leather that is greater than the coefficient of friction of the underlying material of panel 428 with leather. In one implementation, gripping material 460 is inelastic. In some implementations, gripping material 460 may be omitted.

In the example illustrated, the exterior surface of palm panel 428 additionally supports or carries individual elevated pads 431. Pads 431 may be carried within individual pockets, or may be welded, stitched, fused or otherwise secured and retained against the exterior surface of palm panel 428. In other implementations, pads 431 may be omitted.

Finger stalls 432 comprise tubular structures extending backhand panel 424 and palm panel 428 (from the formed palm cavity 430) to receive a person's fingers when glove 420 is fit onto a hand. Finger stall 432-1 comprises an index finger stall located and sized to receive a person's index finger. Finger stall 432-2 comprises a middle finger stall to receive a person's middle finger. Finger stall 432-3 comprises a ring finger stall to receive a person's ring finger. Finger stall 432-4 comprises a pinky stall to receive a person's pinky.

Thumb stall 436 comprise a generally tubular structure extending from backhand panel 424 and palm panel 428 (forming the palm cavity 430) and is located relative to finger stalls 432 so as to receive a person's thumb when glove 420 is fit onto a hand.

In the example illustrated, each of finger stalls 432 and thumb stall 436 have a back side (shown in FIG. 12 and extending from backhand panel 424) that supports at least one pad 437. The pad may be captured within a fixed pocket or maybe bonded, sown otherwise secured to the exterior of each of the stalls 432, 436. In some implementations, all or some of the pads 437 may be omitted.

In the example illustrated, each of the finger stalls 432 and thumb stall 436 have a front side (shown in FIG. 11 and extending from palm panel 428) further carrying or supporting a gripping material 461, similar to gripping material 460 described above. In the example illustrated, the gripping material 461 may comprise a continuous panel of gripping material or may comprise individual separate panels of gripping material, wherein the multiple gripping panels are separated from one another at the joints of the fingers or thumb.

Figure 14:
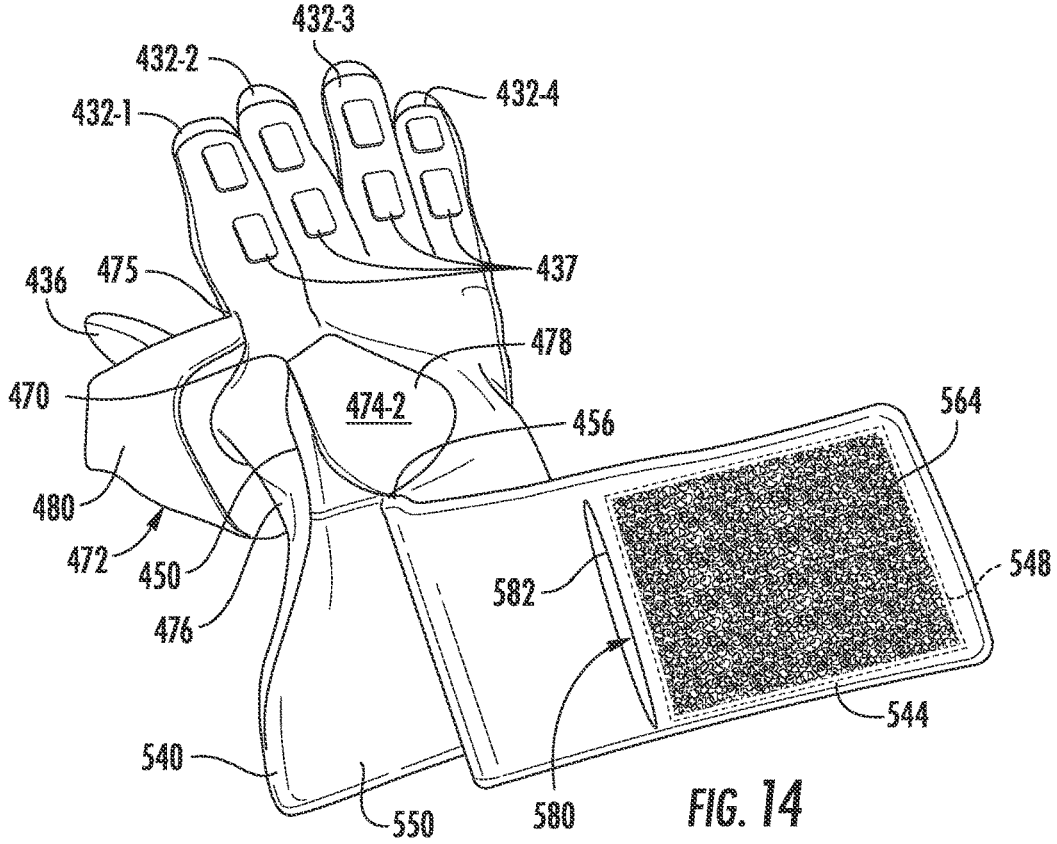
FIG. 14 is another perspective view of the rear of the example sports glove of FIG. 11 with the undeployed securement panel and the unwound or open wrist strap.

As shown in FIGS. 13-14, slit 450 comprises an elongated opening extending through or within backhand panel 424. Slit 450 distally extends from base portion 456 of the palm cavity 430 to a terminus 470 that is located between a portion of finger stall 432-1 and thumb stall 436. In the example illustrated, terminus 470 is located at an index metacarpal (the metacarpal of the index finger received within finger stall 432-1), or between the index metacarpal and a thumb metacarpal (the metacarpal of the thumb received within thumb stall 436) of the hand 451 received within glove 420. In the example illustrated, an edge of the slit 450 extends along an axis coinciding with the index finger stall 432-1. In other implementations, the edges of slit 450 may extend at other locations generally between thumb stall 436 and the edge of index finger stall 432-1 closest to middle finger stall 432-2.

In one implementation, terminus 470 of slit 450 is distally beyond a base of a proximal thumb phalanx of the hand received within the glove. In one implementation, the terminus 470 of slit 450 is distally beyond a base of the thumb metacarpal of the hand received within the glove. In one implementation, the slit 450 extending through the backhand panel 428 has a length of at least one inch. In one implementation, slit 450 has a length of at least 1.5 inches extending from base portion 56 to terminus 470. In one implementation, slit 450 has a length of at least 2 inches. In other implementation, slit 450 can have a length of at least 3 inches. In other implementation, the slit 450 can have a length of at least 4 inches. In the example illustrated, the end of slit 450 opposite terminus 470 connects to or communicates with the opening of slit 562 in wrist sleeve 540 to facilitate wider expansion of slit 450. In other implementations, the opening forming slit 450 may be closed or not connected to slit 562.

Slit 450 separates both portions of backhand panel 424 from opposite connecting portions of thumb stall 436. Slit 450 allows the spacing between backhand panel 424 and the opposite connecting portions of thumb stall 436 to be adjusted or widened to allow insertion of larger hands into glove 420. This may be especially important for sports participants who have larger hands, such as linemen. This feature is also especially important for athletes who need to don their glove(s) quickly and efficiently. In some implementations, the opposite edges of slit 450 may be spread apart to further facilitate the additional insertion of a protective insert adjacent to a base of the thumb, such as a protective insert that wraps around or about the base or metacarpal of the thumb. In other implementations, the slit 450 and the terminus 470 of the slit 450 can be positioned at other locations about the back panel of the glove 420.

In one implementation, the thumb stall 436 is sized to receive a protective thumb insert 590. The protective thumb insert 590 can be formed of a gel-to-shell moldable material. Before using the protective thumb insert 590, the player can heat up the insert 590 so that the insert 590 becomes moldable or pliable. Then, the player can apply insert 590 to the base of his or her thumb and form and/or mold the insert 590 about the base of the player's thumb. Then, insert 590 is allowed to cure and harden. Once cured, insert 590 can be inserted within the thumb stall 436 of the glove 420 during use and the insert 590 provides additional protection to the thumb region of the player's hand. In some implementations, the protective insert may comprise a compressible, yet bendable pad that is retained in an arcuate shape by the glove. In another implementation, the protective insert may comprise a moldable and hardenable panel such as a panel including Gel to Shell® technology, commercially available from EVOSHIELD®. For example in some implementations, the moldable and hardenable panel may be inserted between the base of the thumb and the interior surface of the glove 420 as a glove is being worn, wherein the panel is shaped or molded about base of the thumb and subsequently hardens, while the glove is being worn, to a shape that form fits to the hand of the person wearing the glove.

Figure 15:
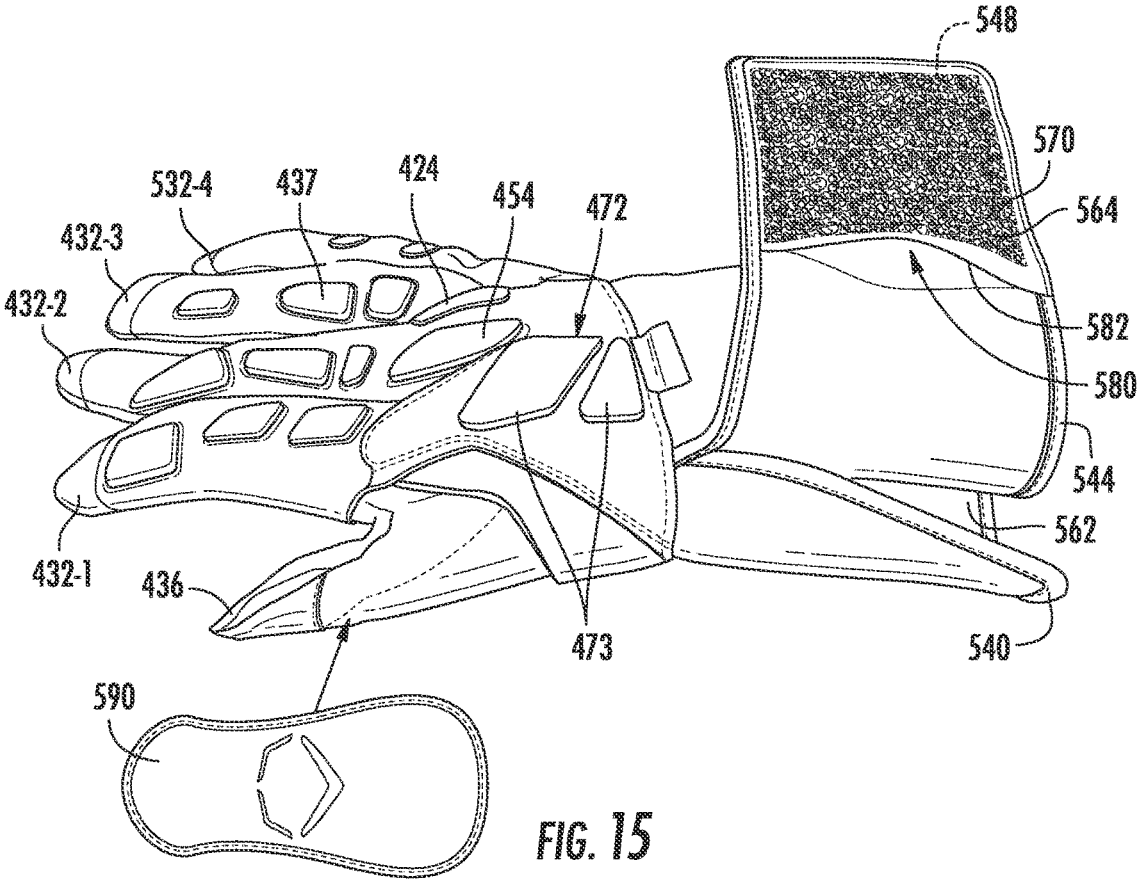
FIG. 15 is a perspective view of a rear of the sports glove of FIG. eleven with the securement panel being deployed and the wrist strap being open or unwound and the protective thumb insert prior to insertion within the glove.

Securement panel 472 comprises a flexible panel anchored to one side of slit 450 between terminus 470 and base 456. In the example illustrated, securement panel 472 has a back face or outer face supporting a plurality of projecting or elevated pads 473 (shown in FIG. 15). In other implementations, pads 473 may be embedded or otherwise imperceptible. In some implementations, pads 473 may be sewn within pockets along the exterior of panel 472. In yet other implementations, pads 473 may be stitched, bonded, welded or otherwise attached to the outer surface of panels 472. Pads 473 provide compressible regions of increased thickness to further cushion and protect the back portions of the person's hand from impact. In yet other implementations, pads 473 may be omitted. FIG. 15 also shows the protective thumb insert 590 prior to insertion within glove 420.

Securement panel 472 is bendable or pivotable about a living hinge (a hinge formed by bendable or foldable region of material that is integrally formed as a single unitary body with materials forming the remainder of the panel) from a first slit opening position, shown in FIGS. 12-14, to a second slit closing position shown FIGS. 15-18. In the slit opening position, the opposite sides of slit 450 are not directly connected to one another and are not bridged, allowing the outsides of slit 450 to be spread apart to varying extents, as desired, to facilitate easier insertion of a person's hand into glove 420 and/are to facilitate the insertion of a protective insert between glove 420 and the hand inserted into glove 420.

Figure 16:
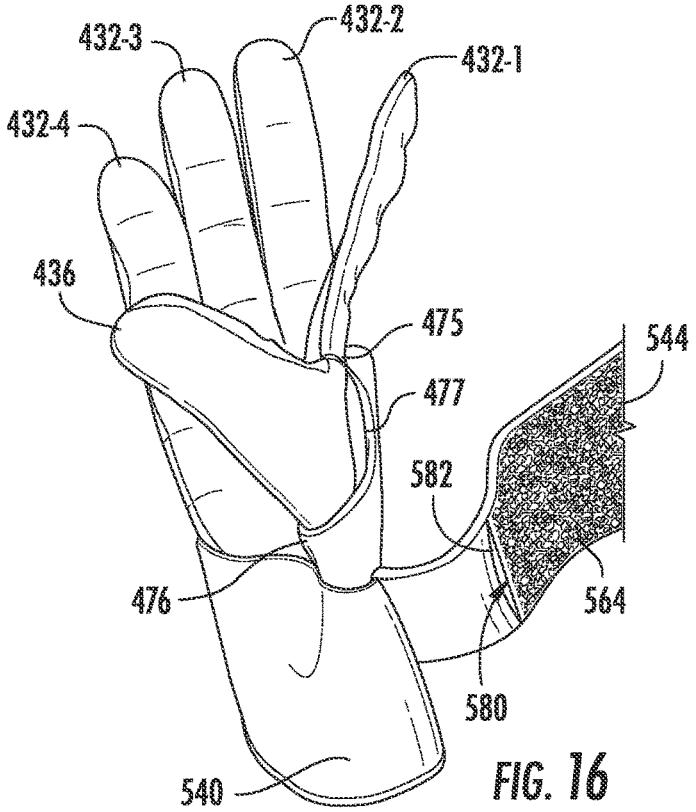
FIG. 16 is a perspective view of a side of the sports glove of FIG. 15 with the securement panel being deployed, illustrating portions of the securement panel detached from a thumb stall of the glove.
Figure 17:
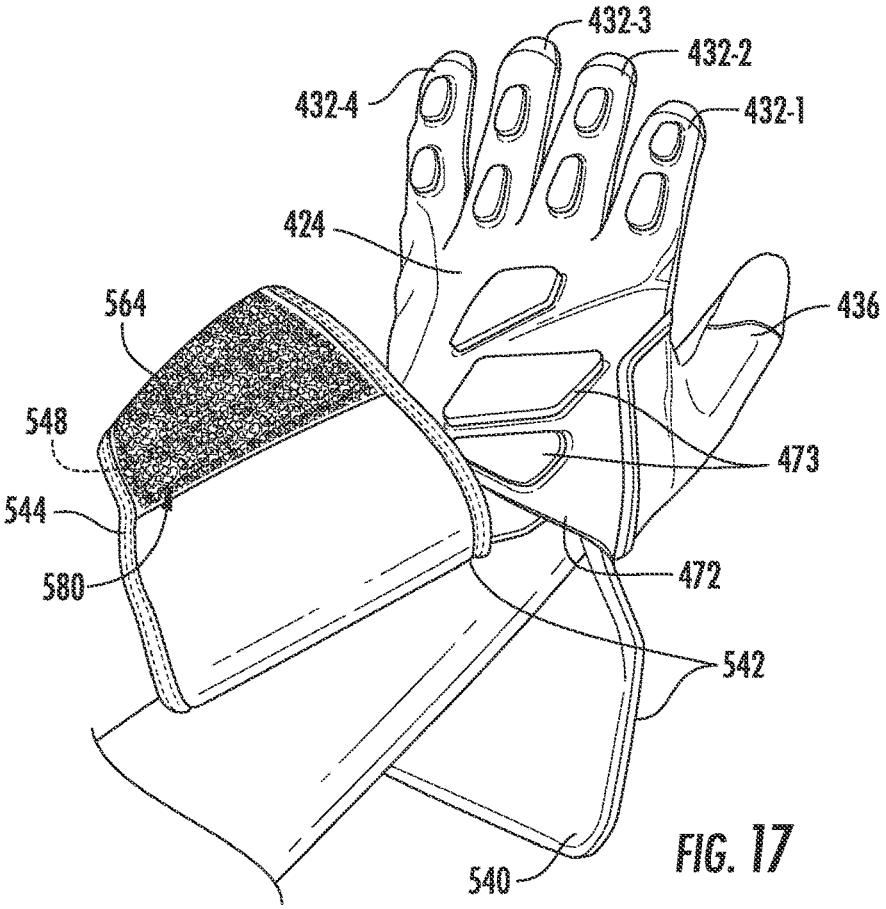
FIG. 17 is a perspective view of a rear of an example sports glove with a user's hand and wrist within the glove and the wrist strap and wrist sleeve open and unwound.

In the slit closing position shown in FIG. 15-20, securement panel 472 extends across slit 450 and is releasably connected to an opposite side of slit 450. As shown by FIGS. 15 and 17, in the slit closing position, securement panel 472 bridges slit 450 to restrict or limit the extent to which the width of slit 450 may be increased, retaining the sides of slit 450 to a maximum spaced apart distance. As a result, once a person has inserted his or her hand into glove 420 and/or has inserted a protective insert, panel 472 may be releasably secured to the other side of slit 450 to close slit 450 to better retain the person's hand and/or protective insert within glove 420 to provide more stability to thumb stall 436.

As shown by FIGS. 12 and 14, the securement panel 472 is secured on a first side of the thumb stall 436 and on a second side of the thumb stall 436 so as to loosely extend over the thumb stall. In the example illustrated, the securement panel 472 is anchored at two spaced locations 475, 476 on different sides of the base of the thumb stall 436, wherein portions 477 of the securement panel 472 are detached from the remainder the glove 420 between the spaced locations 475, 476, free-floating. As shown by FIG. 16, in the slit closing position, the central portion 477 remains detached from the thumb stall 436 about which securement panel 472 wraps. As a result, thumb stall 36 may be moved relative to portion 477 for enhanced mobility such as when a grip is being closed.

In the example illustrated, securement panel 472 is illustrated as being anchored to glove 420 on a side of slit 450 closest to thumb stall 436, wherein securement panel 472 extends away from thumb stall 436 towards finger stall 432-4 when in the slit closing position. In other implementations, this relationship may be reversed. In particular, securement panel 472 may alternatively be anchored to backhand panel 424 on the side of slit 450 closest to finger stall 432-4, wherein securement panel 472 bridges or extends across slit 450 and is releasably secured to an outside of slit 450 closest to thumb stall 436.

In the example illustrated, securement panel 172 is releasably secured in the slit closing position using a hook and loop fastener arrangement. In the example illustrated, an inner face 480 of securement panel 172 includes one a hook and loop 474-1 while the opposite side of slit 450 supports or carries panel or patch 478 having the other of the hook and loop 474-2. This arrangement facilitates the connection of securement panel 172 to a variety of different locations and positions, providing a multitude of different slit spacings or widths to accommodate differently sized hands and/or differently sized protective inserts. In other implementations, secure panel 174 may be releasably connected to an opposite side of slit 50 by other fasteners or connection mechanisms.

FIGS. 17-20 illustrate wrist sleeve 540 and wrist strap 544 in more detail. Wrist sleeve 540 comprises a generally tubular band of material extending from base portion 456 of the palm cavity. Wrist sleeve 540 generally extends about a person's wrist adjacent to the person's hand. In the example illustrated, wrist sleeve 544 is formed from a compressible and elastic material such as a neoprene to provide a compression fit when pulled and wrapped about the person's wrist. In the example illustrated, wrist sleeve 540 includes a slit 562 extending across wrist sleeve 540 to facilitate and larger opening of wrist sleeve 540. In the example illustrated, slit 562 is connected to slit 450.

Figure 18:
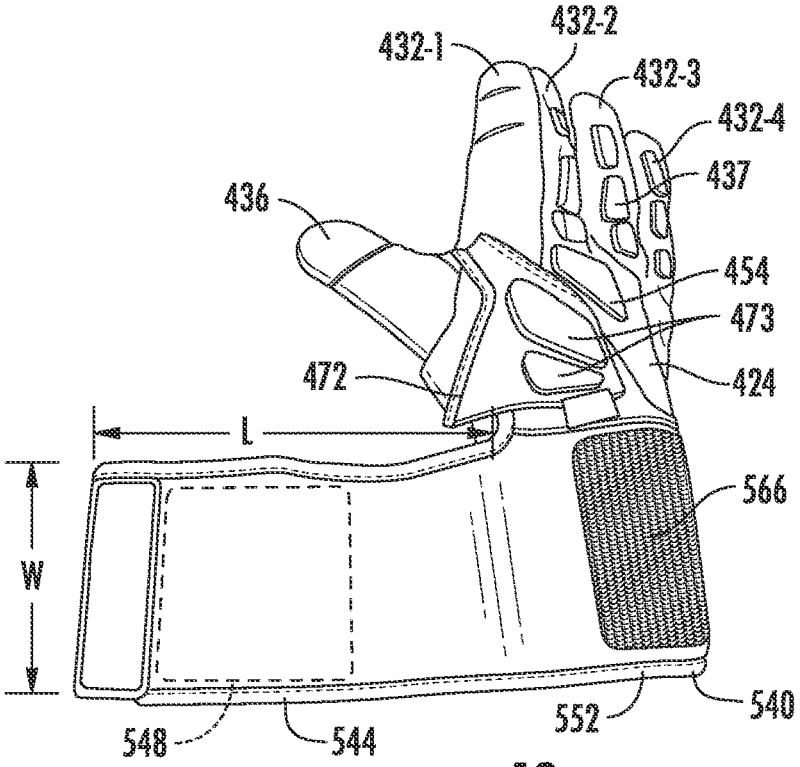
FIG. 18 is a perspective view of a rear of the sports glove of FIG. 11 with the wrist strap being open or unwound.
Figure 19:
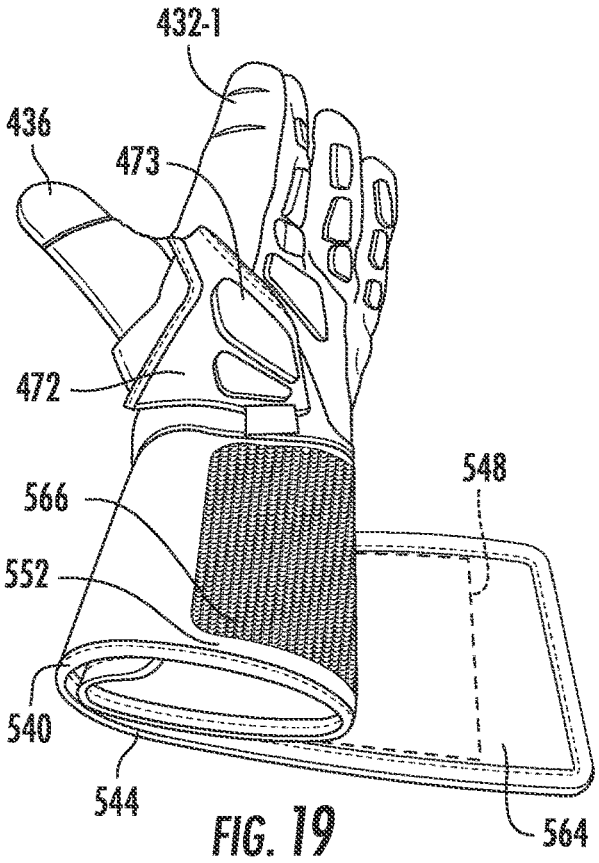
FIG. 19 is a perspective view of a rear of the sports glove of FIG. 11 illustrating the wrist strap being partially wound.
Figure 20:
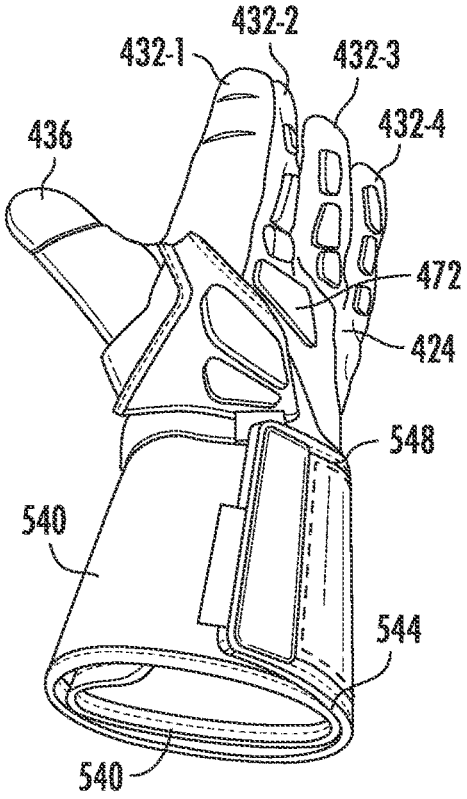
FIG. 20 is a perspective view of the rear of the sports glove of FIG. 11 with the wrist strap being fully wound.

Wrist strap 544 comprises a strap anchored to wrist sleeve 540 on one side of slit 562 and releasably connectable to wrist sleeve 540 on opposite side of slit 562. In the example illustrated, wrist strap 544 is flexible and elastic. In another implementation, strap 44 is flexible, but inelastic. Wrist strap 544 extends across slit 562 to close sleeve 540. As shown by FIGS. 18-20, wrist strap 544 extends from a first side of slit 562 along the back of glove 420, proximate to or between index finger stall 432-1 and thumb stall 436. Wrist strap 544 has a length sufficient so as to extend around the radius side of the person's wrist, completely across the front side of sleeve 540 and the front side of glove 420, and around the ulna side of the person's wrist to a terminus where wrist strap 544 is releasably secured to a back side of wrist sleeve 540 or, in some implementations, past an edge of slit 457 so as to be releasably connected to itself.

In one implementation, wrist sleeve 540 has a front side or portion 550 (shown in FIG. 14) having a first length generally extending from the ulna to the radius of the forearm connected to the hand received within the glove and adjacent to an extending from palm panel 428. Wrist sleeve 540 has a back portion 552 (shown in FIG. 18) adjacent to and extending from backhand panel 424. In such an implementation, wrist strap 544 has a second length L, extending from an edge of slit 562, greater than the first length so as to be wrap-able across and beyond the front portion for releasable connection to the back portion. In one implementation, wrist strap 544 has a length of at least 6 inches. In other implementations, the wrist strap may have a length L within the range of 3 to 12 inches.

Wrist sleeve 540 covers and stabilizes the person's wrist by having a sufficiently wide width W (shown in FIG. 18) so as to extend over at least a portion of the person's forearm. In the example illustrated, wrist sleeve 540 has a width of at least 3 inches. In other implementations, the wrist sleeve 540 may have a width W within the range of 1 to 8 inches. As will be described hereafter, the width of wrist sleeve 540 further facilitates the retention of a wider protective insert, such as a pad or shell, for the protection of the person's ulna bone and ulna side of the wrist and forearm.

In the example illustrated, strap 544 has an inner surface that releasably connects to an outer surface of wrist sleeve 540. In the example illustrated, wrist strap 544 has an inner surface comprising a first portion 564 of a hook and loop fastener arrangement (shown in FIG. 19), whereas the external surface of wrist sleeve 540 has a second portion 566 of the hook and loop fastener arrangement (such as VELCRO™) (shown in FIG. 19). FIG. 20 illustrates wrist strap 544 extending across slit 562 and secured the opposite side of first sleeve 540, securing glove 420 on person's hand.

In the example illustrated in FIG. 15, the second portion 566 of the hook and loop fastener arrangement (comprising either hooks or loops) is supported on a panel 570 that forms a pocket 580 that contains protective insert 548 (schematically illustrated in broken lines). Pocket 580 is located and sized so as to retain protective insert 548 opposite to the ulna side of the wrist and forearm, wherein the protective insert 548 extends in an arc covering and wraps about the ulna bone of the forearm when the wrist strap 544 is wrapped about the wrist and secured to the backside 552 of wrist sleeve 540.

In the example illustrated, pocket 580 comprises an insertion opening 582 (shown in FIG. 15) through which protective insert 548 may be removably inserted into pocket 580, allowing protective insert 580 to be replaced or removed when glove 420 is to be used without protective insert 548. In other implementations, pocket 580 is sealed by stitching, adhesives or the like to permanently retain protective insert 548 within pocket 580.

Protective insert 548 is sized and located such that when it is within pocket 580, protective insert 548 wraps about an extends over the ulna side (pinky side) of the wrist and the ulna bone of the forearm when glove 420 is being worn. As shown by FIGS. 7 and 8, which illustrate the extent and positioning of protective insert 548 when the strap 544 is wrapped around the person's wrist and secured, protective insert 348 extends in an arc so as to wrap about the ulna bone or ulna side of a person's wrist and/or forearm. In one implementation, protective insert 548 may comprise a compressible pad. One implementation, the compressible pad may be generally rectangular in shape and have a thickness of at least 0.25 inches. In another implementation, protective insert 548 may comprise a moldable and hardenable shell or panel such as a panel including Gel to Shell® technology, commercially available from EVOSHIELD®. In one implementation, the moldable and hardenable panel may comprise a gel to shell panel having a thickness of at least 0.125 inches. In other implementations, the protective insert 548 and/or the pocket 580 may take other shapes and sizes.

In implementations where protective insert 548 comprises a moldable and hardenable panel, such as a gel to shell panel, prior to being hardened, the moldable and hardenable panel may be inserted into pocket 580. Following such insertion, wrist strap 544 may be wrapped to the state shown in FIG. 20 to custom shape the arcuate shape of the panel to the ulna side of the wrist. While the gel to shell panel is held in this arcuate shape, custom fit to the person's wrist and forearm, the gel to shell panel is allowed to harden (such as through curing), permanently retaining the custom fit shape for subsequent use.

Figure 21:
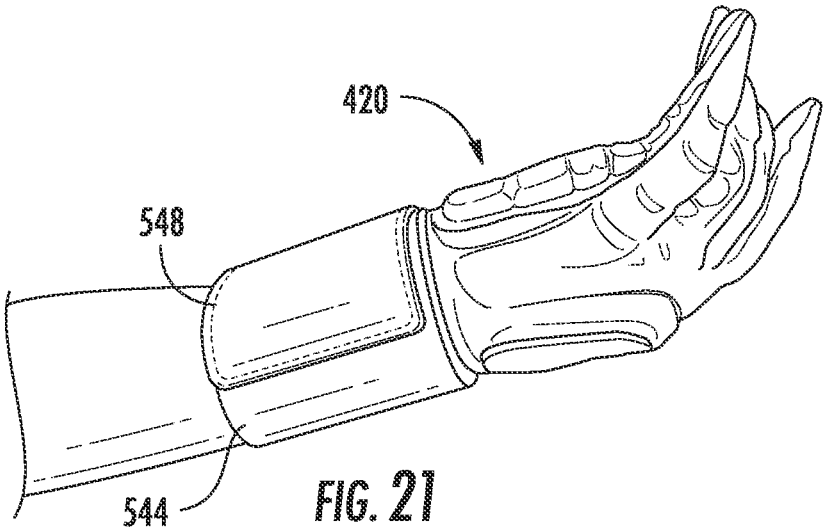
FIG. 21 is a perspective view of a side of the sports glove of FIG. 11 while being worn.
Figure 22:
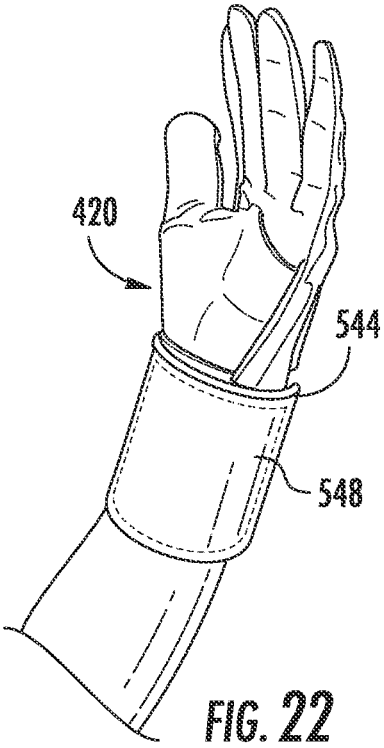
FIG. 22 is a perspective view of a front of the sports glove of FIG. 11 while being worn.

FIGS. 21 and 22 illustrate glove 420 being worn on a person's hand. FIGS. 21 and 22 illustrate the outline of protective insert 548 within pocket 580. As shown by FIGS. 21 and 22, protective insert 548 extends in an arc so as to wrap about the ulna bone or ulna side of a person's wrist and/or forearm. As described above with respect to glove 320, in various sports, the ulna side of a person's wrist and/or forearm may be particularly susceptible to contact and injury. For example, glove 420 and its protective insert 548 may be used as a batter's glove to protect the ulna side of the player's forearm and wrist. In such an implementation, the provision of pads on the palm and/or backside of glove 520 may be omitted. The gripping material on the front side of glove 420 may also be omitted.

Figure 23:
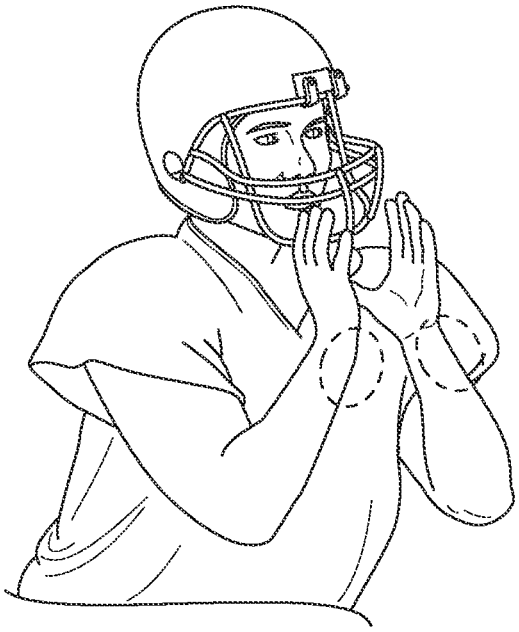
FIG. 23 is a perspective view of an example offensive lineman in a blocking stance, illustrating vulnerability of the ulna side of a wrist and forearm to impact, wherein the sports glove of FIG. 11 may offer protection for the vulnerable ulna side of the wrist and forearm.

Another example of a sport for which glove 420 may be used to protect the ulna side of the person's wrist and forearm is American football. FIG. 23 illustrates an example blocking stance of an offensive lineman when opposing a defensive player. As shown by FIG. 23, in this blocking stance, the ulna side of the person's wrist and forearm (circled by broken lines for identification) face in a generally forward direction towards the defense and the defensive lineman being opposed. As a result, the ulna side of the person's wrist and forearm may be more vulnerable to impact from the opposing player's helmet, shoulder pads or other impacts. By supporting a protective insert 548 around and about the ulna side of the wrist and forearm, the example sports gloves 420 better protect these vulnerable portions of the player's anatomy. The sports glove 420 can also be used by football players playing other positions.

Figure 24:
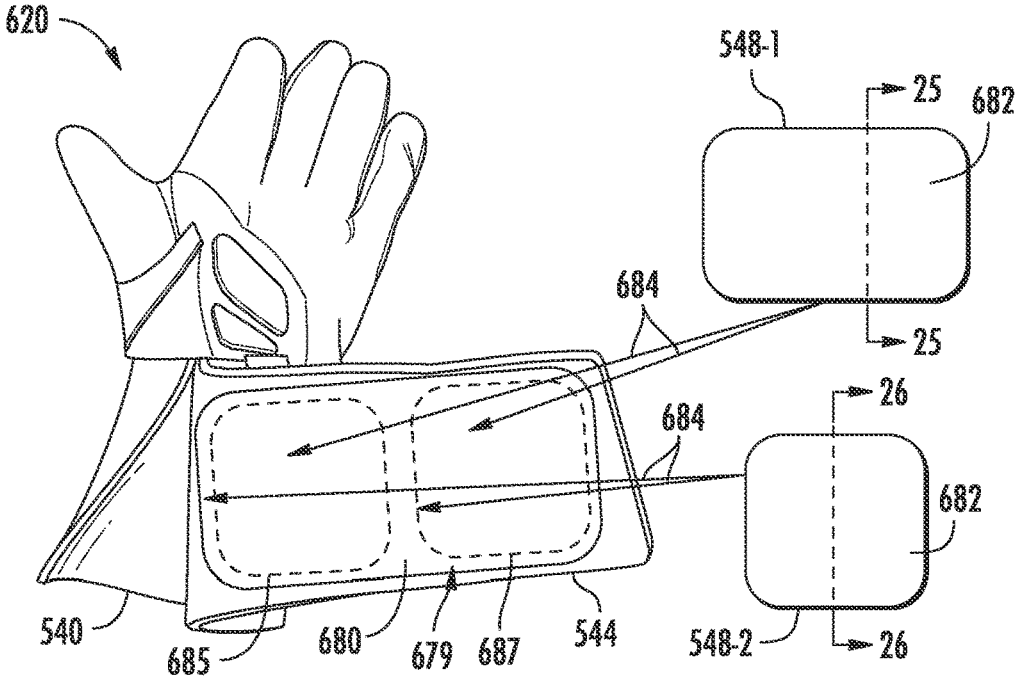
FIG. 24 is a perspective view of a rear or back of an example sports glove, FIG. 24 further illustrating a pair of interchangeable protective inserts that may be used as part of the example sports glove.

FIG. 24 is a perspective view of a back of an example sports glove 620. Sports glove 620 is similar to sports glove 420 described above except that sports glove 620 comprises an additional or alternative retention system 679 for securing a protective insert, or multiple protective inserts, and place between the wrist sleeve 540 and the wrist strap 544. The remaining components of sports glove 620, which correspond to components of sports glove 420, are numbered similarly and/or are shown in FIGS. 11-22.

Retention system 679 releasably secures a selected one of a plurality of different sized protective inserts in place relative to wrist sleeve 540 and/or wrist strap 544. In the example illustrated, retention system 679 is configured to releasably secure protective insert 548-1 or 548-2 in place. Protective insert 548-1 and protective insert 548-2 are different from one another in size. In some implementations, inserts 548-1 and 548-2 may have the same composition. In other implementations, protective inserts 548-1 and 548-2 may have different compositions, such as different thicknesses or stiffnesses/hardness is upon hardening (in the case of a gel to shell panel) or different degrees of compressibility (in the case of a compressible pad).

Retention system 679 releasably retains a selected one of inserts 548-1, 548-2 along the inner surface of wrist sleeve 544. In the example illustrated, retention system 679 comprises a large patch 680 providing a first portion of hook and loop fastener arrangement while each of inserts 548-1 and 548-2 comprise a surface supporting at least one additional patch 682 providing a second portion of the hook and loop fastener arrangement. As a result, each of patches 548-1 and 548-2 may be interchangeably and releasably mounted to patch 680.

In the example illustrated, patch 680 has a surface area and/or length greater than the surface area or length of protective inserts 548-1 and 548-2. As indicated by arrows 684, because protective inserts 548-1 and 548-2 are not positioned within a pocket and are positively secured by the hook and loop arrangement, protective inserts 548-1 548-2 may be secured at any one of a multitude of different positions along the area of patch 680 without fear of inadvertent moving of protective inserts 548-1 or 540-2 relative to wrist sleeve 544. For example, as shown by broken lines, protective insert 548-2 may be located at a first position 685 or alternatively at a second position 687. Consequently, glove 620 provides the person wearing glove 620 with a great deal of flexibility as to not only the size and characteristics of the protective insert, but its positioning relative to his or her hand, wrist and forearm. In some implementations, retention system 679 is provided in lieu of pocket 580 described above. In yet other implementations, retention system 679 may be provided in addition a pocket 680, wherein patch 680 is formed on the outer surface of pocket 580, providing a person with the choice of either using pocket 580 to receive a protective insert or using patch 680 to secure at least one protective insert.

Figure 25:
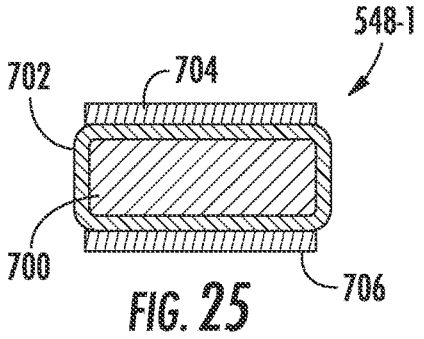
FIG. 25 is a sectional view of one of the protective inserts of FIG. 24 taken along line 25-25.

FIG. 25 is a sectional view illustrating one example of protective insert 548-1. Protective insert 548-1 comprises an interior panel 700, and outer packaging 702 and a pair of opposing hook and loop patches 704, 706. Interior panel 700 provides a majority of the thickness, compressibility and/or thickness of protective insert 548-1. In one implementation, interior panel 700 comprises a gel to shell panel such as commercially available from EVOSHIELD®. In another implementation, interior panel 700 comprises at least one layer of compressible material such as a foam.

Outer packaging 702 encloses interior panel 700. In one implementation, outer packaging 702 comprises a polymeric film or other layer encapsulating panel 700. In another implementation, outer packaging 702 comprises a fabric enclosing layer 700. In one implementation, outer packaging 702 has a repeatedly openable and closable opening, such as with a zipper or hook and loop fastener arrangement to allow packaging 702 to be separated from panel 700 for cleaning or replacement.

Patches 704, 706 comprise regions containing portions of the hook and loop fastener arrangement, such as hooks or loops (sometimes referred to as VELCRO®). Patch 704 is configured to releasably attach to patch 680 on wrist strap 544. Patch 706 is configured to releasably attached to an opposite component of hook and loop fastener arrangement supported by wrist sleeve 540, such as patch 566 shown in FIG. 18. As a result, protective insert 548 is secured on both its front face and his back face when wrist strap 544 is wrapped about wrist sleeve 540. In some implementations, patch 680 and patch 704 may be omitted, where protective insert 548-1 is secured through the connection of a first hook and loop fastener portion provided by patch 706 to a second different hook and loop fastener portion provided on wrist sleeve 540, such as patch 566 shown in FIG. 18. In some implementations, patch 706 may be omitted, wherein protective insert 548-1 simply abuts the opposing portions of wrist sleeve 540 and wherein portions of wrist strap 544 extending beyond insert 548-1 are releasably connected to wrist sleeve 540.

Figure 26:
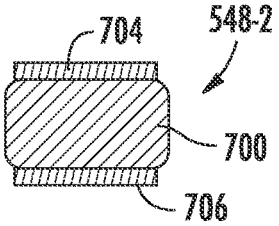
FIG. 26 is a sectional view of another of the example protective inserts of FIG. 24 taken along line 26-26.

FIG. 26 is a cross-sectional view of an example protective insert 548-2 insert 540-2 is similar to insert 548-1 except that insert 540-2 is differently sized and omits packaging 702. In the example illustrated, patches 704 and 706 are directly bonded, welded, adhered or secured to exterior surfaces of interior panel 700.

Figure 27:
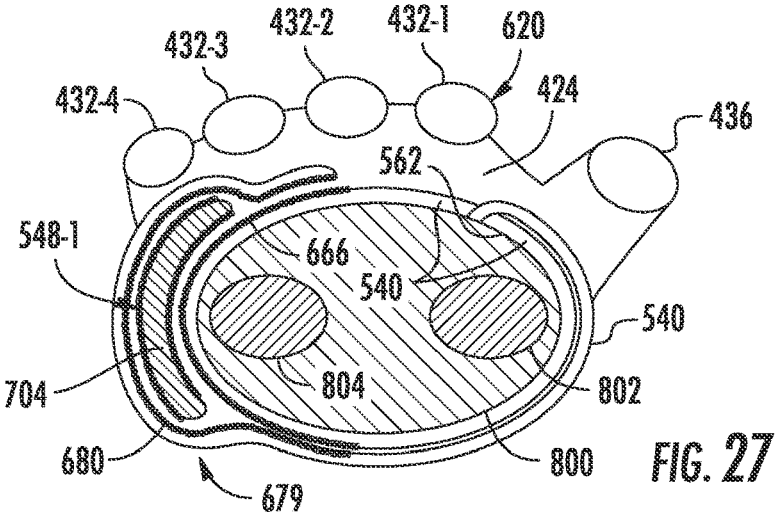
FIG. 27 is a sectional view through the forearm of a person wearing the example sports glove of FIG. 24.

FIG. 27 is a sectional view taken through the forearm 800 of a person wearing glove 620. The radius 802 and ulna 804 of wrist 800 are schematically represented. Portions of the finger stalls 432-1, 432-2, 432-3, 432-4 and thumb stall 436 are also schematically represented.

As shown by FIG. 27, wrist sleeve 540 extends about wrist 800 and include slit 562. A radial outer surface of wrist sleeve 540 includes a patch 666 of a first portion of a hook and loop arrangement. Wrist strap 544 extends from wrist sleeve 540 and is wound over the underlying portions of wrist sleeve 540. A radial inner surface of wrist strap 544 includes an enlarged patch 680 containing a first portion of a hook and loop arrangement.

Protective insert 548-1 extends in an arc on the ulna side of glove 620, about the ulna bone 804 when glove 620 is being worn. Patch 704 comprises a second portion of the hook and loop arrangement of patch 680. Patch 706 comprises a second portion of the hook and loop arrangement of patch 666. As a result, protective insert 548-1 is sandwiched between the sleeve 540 and wrist strap 544 while being secured on both its inner face and its outer face.

As discussed above, in some implementations, patch 680 and patch 704 may be omitted, where protective insert 548-1 is secured through the connection of a first book and loop fastener portion provided by patch 706 to a second different hook and loop fastener portion provided on wrist sleeve 540, such as patch 666. In some implementations, patch 706 may be omitted, wherein protective insert 548-1 simply abuts the opposing portions of wrist sleeve 540 and wherein portions of wrist strap 544 extending beyond insert 548-1 are releasably connected to wrist sleeve 540. In one implementation, both of patches 704 and 706 comprise hooks or loops while both of patches 680 and 666 comprise the other of hooks or loops.

In one implementation in which interior panel 700 comprise a moldable and hardenable gel to shell material, moldable inserts 548-1 or 548-2 are secured in the arcuate orientation shown FIG. 27 about wrist 800. While secured in this arcuate shape, the material is allowed to harden, such as through curing, so as to subsequently retain a rigid custom form-fit shape to wrist 800. In one implementation, protective insert 548-1, prior to any hardening, is bent and molded to conform to the shape of the forearm 800 through the connection between patch 706 and patch 666, without wrist strap 544 being wrapped over insert 548-1. In one implementation, protective insert 548-1, prior to any hardening, is secured in an unbent state through the connection between patch 680 and patch 704, wherein protective insert 548-1 is molded to an arcuate shape as strap 544 is wrapped further about forearm 800. As discussed above, the use of the various patches 704, 706 and 680 allows a person wearing glove 620 to selectively locate the protective interface and to use a protective interface having a selected size that best suits the preferences of the person wearing glove 620.

Figure 28:
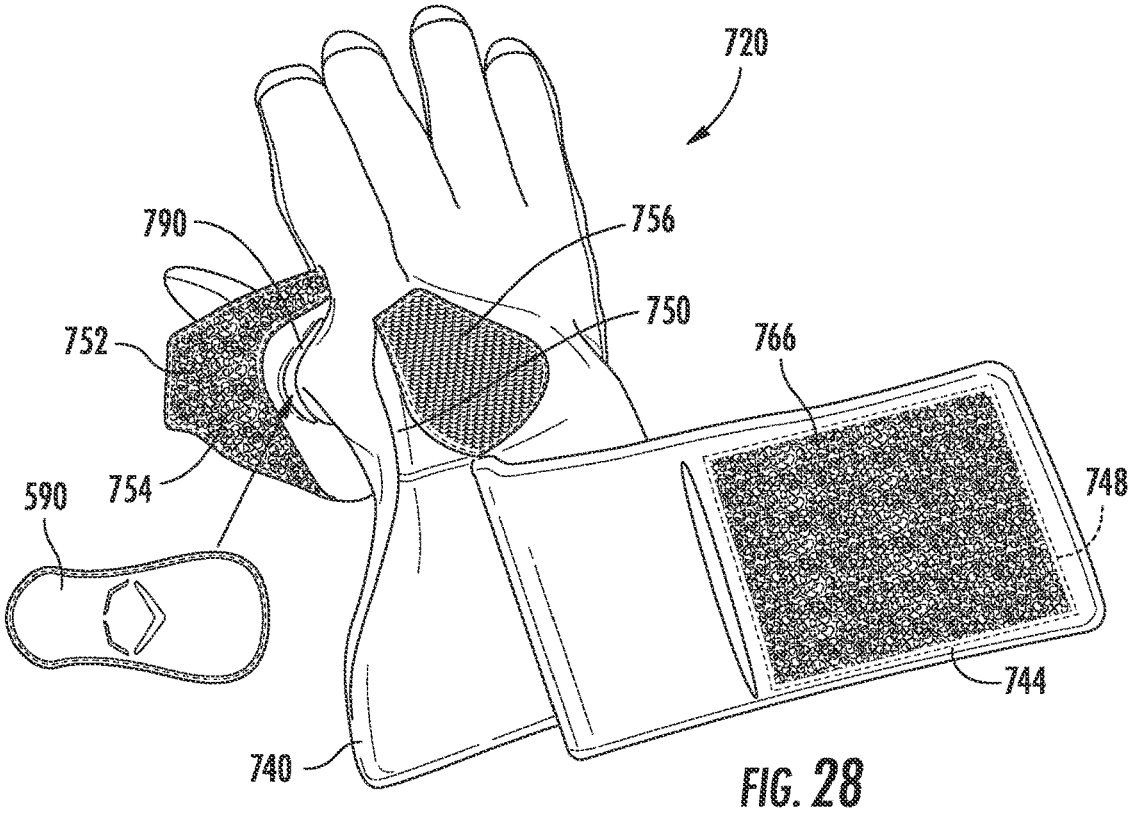
FIG. 28 is a rear perspective view of another example sports glove with a securement panel shown open, a wrist strap shown open or unwound, and a protective thumb insert shown prior to insertion within the sports glove.
Figure 29:
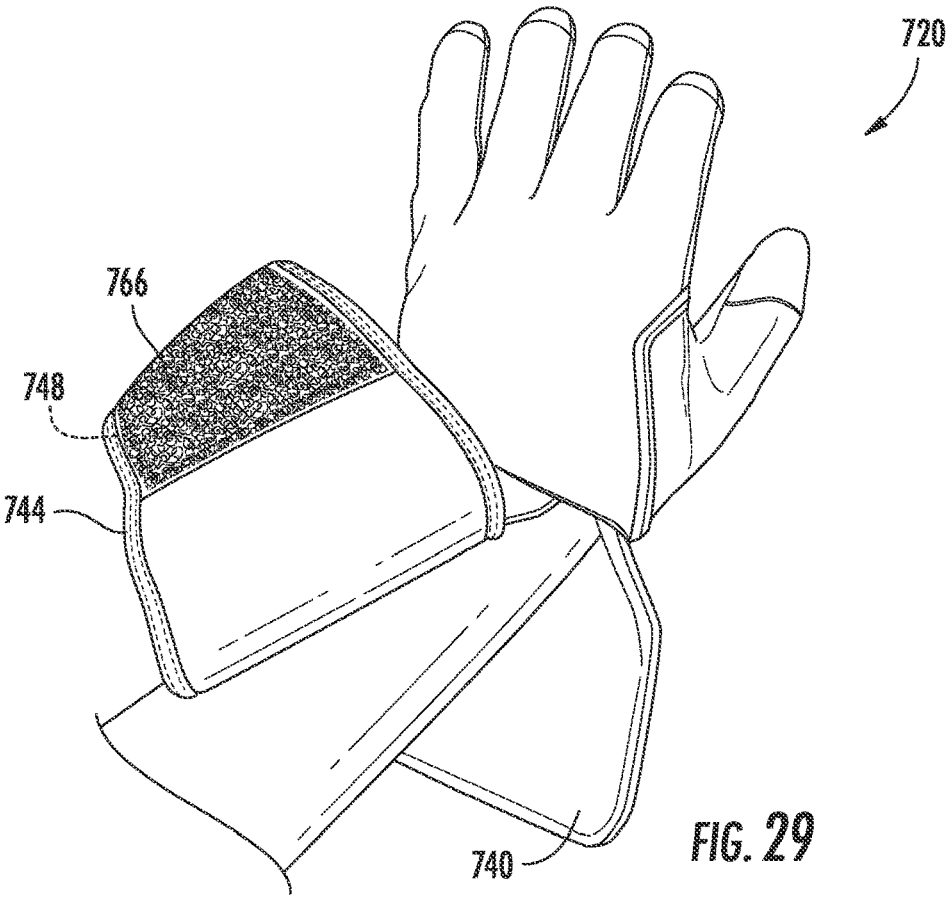
FIG. 29 is a rear perspective view of a sports glove similar to the glove of FIG. 28 with the player's hand and the protective thumb insert positioned within the glove, the securement panel closed, and the wrist strap shown open and unwound.
Figure 30:
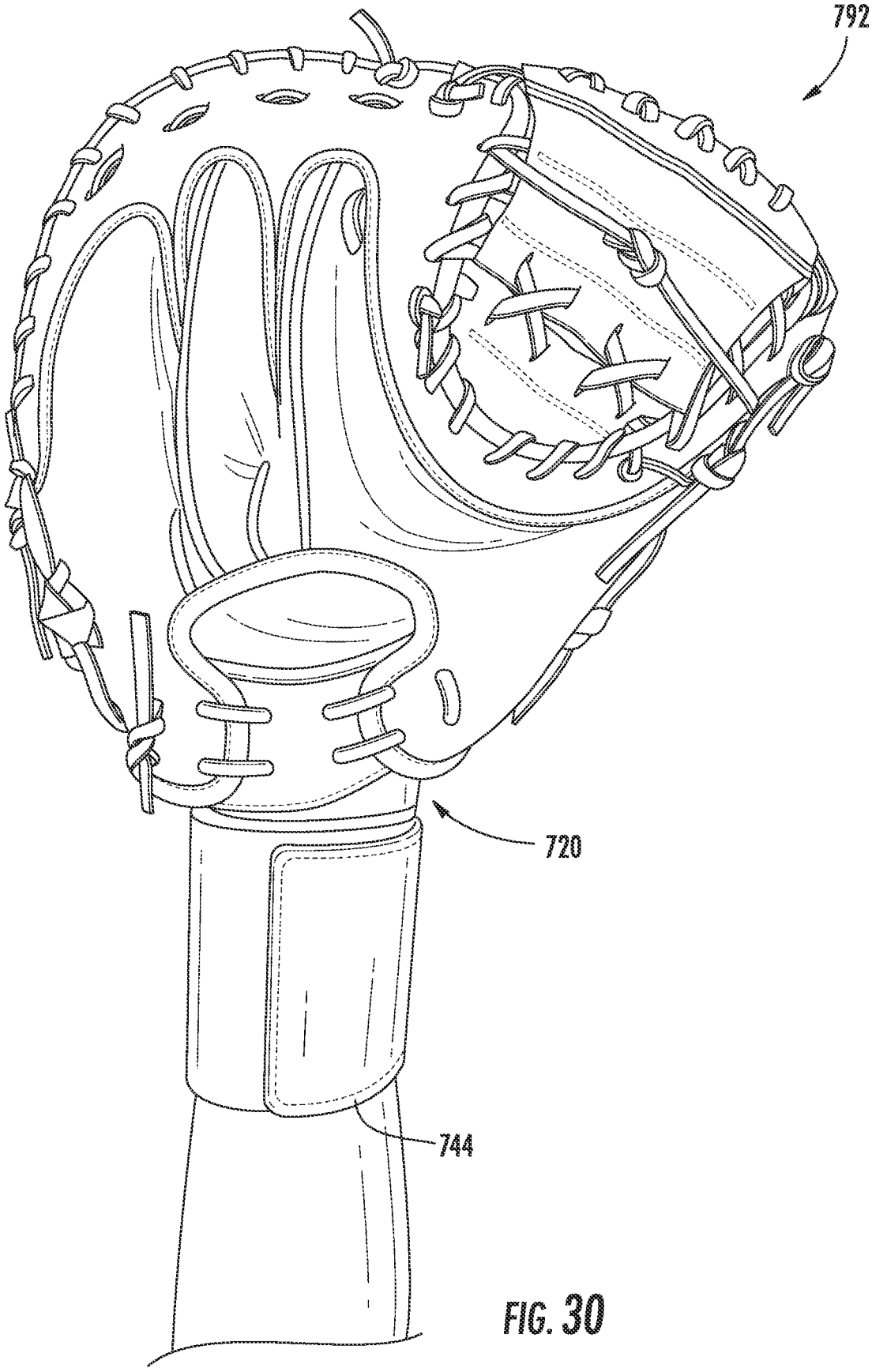
FIG. 30 is a rear perspective view of the sports glove of FIG. 29 inserted within a catcher's mitt with the wrist strap of the sports glove shown closed and wound around the player's wrist.

FIGS. 28-30 illustrate another example sports glove 720. The sports glove 720 is substantially similar to the sports glove 420 of FIGS. 13-15. Unlike sports glove 420, the sports glove 720 is formed without pads (like pads 437) on the back of the finger stalls or the back of the hand portion (or back panel) of the glove 720. The sports glove 720 is configured for applications where pads on the back of the finger stalls and back of the hand portion of the glove are not necessary. One such example is the use of the sports glove for a catcher in the sport of baseball or softball. The sports glove 720 formed without the extra pads can be more easily placed or inserted within a catcher's mitt 792 (FIG. 30).

Referring to FIG. 28, the sports glove 720 is shown in a fully opened position with a securement panel 752 open and detached from the back of the hand portion of the sports glove 720. The sports glove 720 includes a slit 750 that extends up the back of the hand portion of the glove 720 toward the base of the index finger stall. The slit 750 provides an enlarged opening that enables a ball player to quickly and easily don the sports glove 720 without having to waste time squeezing his or her hand into the glove 720 and/or pulling on the glove to get the player's hand fully within the glove. With the slit 750, the player is able to quickly and efficiently place his or her hand in the glove 720. For catchers, this can be particularly helpful between innings, or following at bats.

The securement panel 752 is anchored through the use of fasteners 754 and 756 on different sides of the slit 750. Fastener 752 can be positioned on the inner surface of the securement panel 752 and fastener 754 can be placed on the back of the hand portion of the sports glove 720. The fasteners 754 and 756 can be hook and loop type fasteners. In other implementations, other forms of fasteners, such as snap-fit fasteners, can be used. When the securement panel is opened 752 as shown in FIG. 28, the slit 750 provides a large opening for receiving the player's hand and for receiving a protective thumb insert 590 within the thumb stall region of the sports glove 720. In one implementation, the sports glove 720 can include a pocket for receiving the protective thumb insert 590. In another implementation, the protective thumb insert 590 is positioned in the sports glove 720 on the player's hand and the glove 720 and the molded shape of the protective thumb insert 590 keeps the protective thumb insert 590 in place during use without a pocket.

Referring to FIG. 29, the sports glove 720 is shown with the securement panel 752 in a closed position with the securement panel 752 secured to the back of the hand portion of the sports glove 720. The securement panel 752 extends over and essentially covers the slit 750.

FIG. 29 is a rear perspective view of a sports glove 720 similar to the glove of FIG. 28 with the player's hand and the protective thumb insert 590 positioned within the glove, and the securement panel 752 is closed. The sports glove 720 includes a wrist sleeve 740 and an enlarged wrist strap 744. In FIGS. 28 and 29, the wrist strap 744 is shown open and unwound. The wrist strap 744 is configured to receive a protective insert 748. The protective insert 748 is substantially the same as protective insert 548. As shown on FIG. 28, the inner surface of the wrist strap 744 can include a pocket for receiving the protective insert 748. The inner surface of the wrist strap 744 can also include a patch 766 of fastening material, such as a hook and loop fastening material.

FIG. 30 is a rear perspective view of the sports glove 720 of FIG. 29 inserted within a catcher's mitt with the wrist strap 744 of the sports glove shown closed and wound around the player's wrist and engaged with the wrist sleeve 740. The outer surfaces of the wrist sleeve 740 and/or the wrist strap 744 can also include hook and loop fastening material that releasably engages the patch 766 to secure the wrist strap 744 around the player's wrist. The player then can readily insert the hand portion of the glove 720 within the catcher's mitt 792 while the wrist portion of the sports glove (the wrist strap 744 and the wrist sleeve 744 remain outside of the catcher's mitt 792 and protect the player's wrist from pitched or hit balls during play.

Although the present disclosure has been described with reference to example implementations, workers skilled in the art will recognize that changes may be made in form and detail without departing from disclosure. For example, although different example implementations may have been described as including features providing various benefits, it is contemplated that the described features may be interchanged with one another or alternatively be combined with one another in the described example implementations or in other alternative implementations. Because the technology of the present disclosure is relatively complex, not all changes in the technology are foreseeable. The present disclosure described with reference to the example implementations and set forth in the following claims is manifestly intended to be as broad as possible. For example, unless specifically otherwise noted, the claims reciting a single particular element also encompass a plurality of such particular elements. The terms "first", "second", "third" and so on in the claims merely distinguish different elements and, unless otherwise stated, are not to be specifically associated with a particular order or particular numbering of elements in the disclosure.

What is claimed is:

1. A sports glove for being worn by a hand of a user, the hand including an index metacarpal and a thumb metacarpal, the sports glove comprising:

a backhand panel;

a palm panel joined to the backhand panel to form a palm cavity therebetween, the palm cavity extending from a base portion to a knuckle portion;

finger stalls extending from the palm cavity, the finger stalls comprising an index finger stall;

a thumb stall extending from the palm cavity, the thumb stall having a thumb stall opening; and a slit within the backhand panel, the slit distally extending from the base portion along an axis that crosses the base portion and that intersects the index finger stall, or that extends between the index finger stall and the thumb stall, the slit having a terminus positioned at a location on the backhand panel such that the terminus is configured to be at the index metacarpal, or between the index metacarpal and the thumb metacarpal, distally beyond a majority of the thumb stall opening and distally proximate the radial fossa, of the hand fully received within the glove and such that the slit separates portions of the backhand panel from opposite connecting portions of the thumb stall.

2. The sports glove of claim 1 further comprising a securement panel extending from a location distally beyond the thumb stall on a first side of the slit, adjacent to and along the backhand panel across the slit in a direction away from the thumb stall and releasably connectable to a second side of the slit, the securement panel being pivotable about a second axis parallel to the axis to extend across and overly the axis.

3. The sports glove of claim 2, wherein the securement panel is releasably connectable to the second side slit by hook and loop fastener providing multiple securement locations.

4. The sports glove of claim 2 further comprising:

a wrist sleeve extending from the base portion of the palm cavity, the slit extending across the wrist sleeve; and a wrist strap extending from a first side of the slit and across the slit and over the axis to wrap about the wrist sleeve.

5. The sports glove of claim 4, wherein the wrist strap comprises a pocket containing a protective insert.

6. The sports glove of claim 5, wherein the pocket is sealed about the protective insert.

7. The sports glove of claim 5, wherein the pocket has a pocket opening and wherein the protective insert is removably positioned within the pocket through the pocket opening.

8. The sports glove of claim 5, wherein the protective insert comprises a compressible pad.

9. The sports glove of claim 5, wherein the protective insert comprises a molded and hardened panel.

10. The sports glove of claim 5, wherein the pocket is located to secure the protective insert as the protective insert extends in an arc that wraps about an ulna side of a forearm of a person wearing the sports glove.

11. The sports glove of claim 2 further comprising pads secured to and carried by the securement panel.

12. The sports glove of claim 2, wherein the securement panel is anchored to a remainder of the sports glove at a first anchor location on a first side of the thumb stall and at a second anchor location on a second side of the thumb stall so as to form an opening between the first anchor location and the second anchor location and through which the thumb stall loosely extends.

13. The sports glove of claim 12, wherein the first anchor location is on the index finger stall and wherein the second anchor location is on the palm panel proximate a junction of the base portion and a beginning of the thumb stall.

14. The sports glove of claim 13, wherein the securement panel overlaps the back panel and is distally spaced from the wrist sleeve and the wrist strap such that the securement panel does not overlap the wrist sleeve and such that the wrist strap does not overlap the securement panel.

15. The sports glove of claim 1 further comprising:

a wrist sleeve extending from the base portion of the palm cavity, the slit extending across the wrist sleeve; and a wrist strap extending from a first side of the slit and across the slit and over the axis to wrap about the wrist sleeve.

16. The sports glove of claim 1, further comprising a securement panel extending from a first side of the slit, across the slit and releasably connectable to a second side of the slit, wherein the slit has first and second opposite edges extending along the axis, wherein the first and second opposite edges extend along first and second axes, respectively, and wherein the first and second axes, along which the first and second opposite edges extend, cross the base portion and intersect the index finger stall, or extend between the index finger stall and the thumb stall, in response to the securement panel retaining the first and second opposite adjacent to one another along the axis.

17. A sports glove for being worn by a hand of a user, the hand including an index metacarpal and a thumb metacarpal, the sports glove comprising:

a backhand panel;

a palm panel joined to the backhand panel to form a palm cavity therebetween, the palm cavity extending from a base portion to a knuckle portion;

finger stalls extending from the palm cavity, the finger stalls comprising an index finger stall;

a thumb stall extending from the palm cavity;

a slit within the backhand panel;

a wrist sleeve extending from the base portion of the palm cavity, the slit extending across the wrist sleeve;

a wrist strap extending from a first side of the slit and across the slit to wrap about the wrist sleeve; and a securement panel overlapping the back panel and extending across the slit, the securement panel being distally spaced from the wrist sleeve and the wrist strap such that the securement panel does not overlap the wrist sleeve and such that the wrist strap does not overlap the securement panel, wherein the securement panel is anchored to a remainder of the sports glove at a first anchor location on a first side of the thumb stall and at a second anchor location on a second side of the thumb stall so as to form an opening between the first anchor location and the second anchor location and through which the thumb stall loosely extends.

18. The sports glove of claim 17, wherein the first anchor location is on the index finger stall and wherein the second anchor location is on the palm panel proximate a junction of the base portion and a beginning of the thumb stall.

19. The sports glove of claim 17, wherein the securement panel has a first free end extending in a first direction from a remainder of the sports glove and wherein the wrist strap has a second free end extending in a second direction, opposite the first direction, from a remainder of the sport glove.

20. A sports glove for being worn by a hand of a user, the hand including an index metacarpal and a thumb metacarpal, the sports glove comprising:

a backhand panel;

a palm panel joined to the backhand panel to form a palm cavity therebetween, the palm cavity extending from a base portion to a knuckle portion;

finger stalls extending from the palm cavity, the finger stalls comprising an index finger stall;

a thumb stall extending from the palm cavity;

a slit within the backhand panel;

a securement panel overlapping the back panel and extending across the slit, wherein the securement panel is anchored to a remainder of the sports glove at a first anchor location on a first side of the thumb stall and at a second anchor location on a second side of the thumb stall so as to form an opening between the first anchor location and the second anchor location and through which the thumb stall loosely extends.

21. A sports glove for being worn by a hand of a user, the hand including an index metacarpal and a thumb metacarpal, the sports glove comprising:

a backhand panel;

a palm panel joined to the backhand panel to form a palm cavity therebetween, the palm cavity extending from a base portion to a knuckle portion;

finger stalls extending from the palm cavity, the finger stalls comprising an index finger stall;

a thumb stall extending from the palm cavity;

a slit within the backhand panel;

a wrist sleeve extending from the base portion of the palm cavity, the slit extending across the wrist sleeve;

a wrist strap extending from a first side of the slit and across the slit to wrap about the wrist sleeve; and a securement panel overlapping the back panel and extending across the slit, the securement panel being distally spaced from the wrist sleeve and the wrist strap such that the securement panel does not overlap the wrist sleeve and such that the wrist strap does not overlap the securement panel, wherein the securement panel has a first free end extending from a remainder of the sports glove in a first direction away from the thumb stall along and adjacent to the backhand panel and wherein the wrist strap has a second free end extending in a second direction, opposite the first direction, from a remainder of the sport glove.

* * * * *